US008790854B2

(12) United States Patent
Kawabata

(10) Patent No.: US 8,790,854 B2
(45) Date of Patent: Jul. 29, 2014

(54) ELECTROPHOTOGRAPHIC PHOTORECEPTOR, IMAGE FORMING APPARATUS, AND PROCESS CARTRIDGE

(71) Applicant: Fuji Xerox Co., Ltd., Tokyo (JP)

(72) Inventor: Yukimi Kawabata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 63 days.

(21) Appl. No.: 13/630,854

(22) Filed: Sep. 28, 2012

(65) Prior Publication Data

US 2013/0252152 A1 Sep. 26, 2013

(30) Foreign Application Priority Data

Mar. 26, 2012 (JP) ..... 2012-069961

(51) Int. Cl.

| | |
|---|---|
| ***G03G 5/14*** | (2006.01) |
| ***G03G 5/147*** | (2006.01) |
| ***G03G 15/00*** | (2006.01) |
| ***G03G 5/047*** | (2006.01) |

(52) U.S. Cl.

CPC ..... *G03G 5/14726* (2013.01); *G03G 15/00* (2013.01); *G03G 5/14713* (2013.01); *G03G 5/047* (2013.01); *G03G 5/14708* (2013.01)

USPC ..... 430/66; 399/159

(58) Field of Classification Search

CPC ..... G03G 5/14708; G03G 5/14713; G03G 5/047; G03G 5/14726; G03G 15/00

USPC ..... 430/66; 399/159

See application file for complete search history.

(56) References Cited

U.S. PATENT DOCUMENTS

2012/0064442 A1* 3/2012 Kawabata et al. ..... 430/56

FOREIGN PATENT DOCUMENTS

| | | |
|---|---|---|
| JP | A-4-324451 | 11/1992 |
| JP | A-2008-46197 | 2/2008 |
| JP | A-2009-145480 | 7/2009 |

* cited by examiner

*Primary Examiner* — Peter Vajda

(74) *Attorney, Agent, or Firm* — Oliff PLC

(57) ABSTRACT

An electrophotographic photoreceptor includes a substrate and a photosensitive layer, wherein the electrophotographic photoreceptor has a surface layer containing fluorine resin particles, and the fluorine resin particles exposed on a surface satisfy the following Expression (1):

$$0.5 \leq (A)/(B) \leq 10 \qquad \text{Expression (1)}$$

wherein, (A) represents a number of aggregated particles in which 5 to 20 fluorine resin particles are connected and aggregated, and (B) represents a total number of fluorine resin particles that are isolated without being aggregated and aggregated particles in which 2 to 4 fluorine resin particles are connected and aggregated.

18 Claims, 4 Drawing Sheets

ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2012-069961 filed Mar. 26, 2012.

BACKGROUND

1. Technical Field

The present invention relates to an electrophotographic photoreceptor, an image forming apparatus, and a process cartridge.

2. Related Art

In recent years, the speed, image quality, and lifetime of so-called xerographic image forming apparatuses having a charging unit, an exposure unit, a developing unit, a transfer unit, and a fixing unit have increased with further technological developments of a system and respective members.

SUMMARY

According to an aspect of the invention, there is provided an electrophotographic photoreceptor including a substrate and a photosensitive layer, wherein the electrophotographic photoreceptor has a surface layer containing fluorine resin particles, and the fluorine resin particles exposed on the surface satisfy the following Expression (1):

$$0.5 \leq (A)/(B) \leq 10 \quad \text{Expression (1)}$$

wherein, (A) represents a number of aggregated particles in which 5 to 20 fluorine resin particles are connected and aggregated, and (B) represents a total number of fluorine resin particles that are isolated without being aggregated and aggregated particles in which 2 to 4 fluorine resin particles are connected and aggregated.

BRIEF DESCRIPTION OF THE DRAWINGS

Exemplary embodiments of the present invention will be described in detail based on the following figures, wherein.

DETAILED DESCRIPTION

Figure 1:
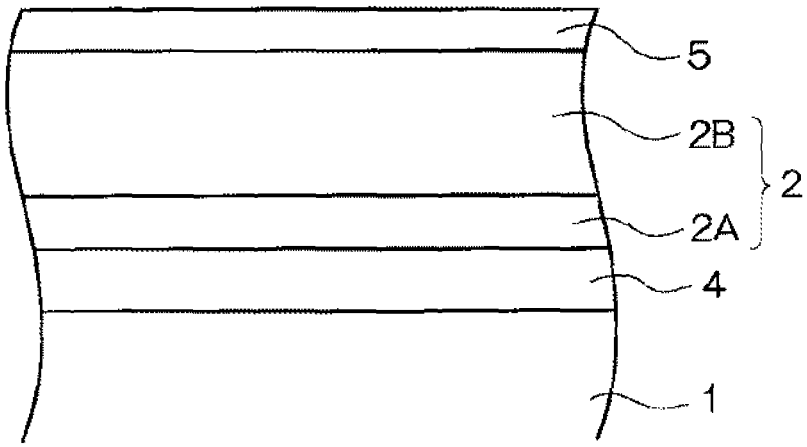
FIG. 1 is a partial cross-sectional view schematically illustrating an electrophotographic photoreceptor according to a first aspect of an exemplary embodiment.

Hereinafter, exemplary embodiments of the invention will be described.

Electrophotographic Photoreceptor

An electrophotographic photoreceptor (hereinafter, also simply referred to as "photoreceptor") according to this exemplary embodiment has a substrate and a photosensitive layer, and a layer constituting an outermost surface layer (hereinafter, also simply referred to as "outermost surface layer") contains fluorine resin particles, and the state of the fluorine resin particles exposed on a surface of the outermost surface layer satisfies the following Expression (1):

$$0.5 \leq (A)/(B) \leq 10 \quad \text{Expression (1)}$$

wherein, (A) represents a number of aggregated particles in which 5 to 20 fluorine resin particles are connected and aggregated, and (B) represents a total number of fluorine resin particles that are isolated without being aggregated and aggregated particles in which 2 to 4 fluorine resin particles are connected and aggregated.

(A)/(B)

In a photoreceptor that has not been used yet in the formation of an image (that is, initial photoreceptor), in the case in which the aggregation of fluorine resin particles exposed on the outer surface of the outermost surface layer is too small or too great, even when the fluorine resin particles migrate to the surface of the photoreceptor, the particles slip through a cleaning member such as a cleaning blade easily, and thus a cleaning property may deteriorate and the fluorine resin particles may not be efficiently accumulated at a position at which the cleaning member and the photoreceptor are brought into contact with each other. When the fluorine resin particles slip through the cleaning member, the fluorine resin particles are not extended to form a thin film on the surface of the photoreceptor. Therefore, the efficiency of the transfer of a toner from the photoreceptor may be reduced in an initial stage in which image formation is started using the photoreceptor.

On the other hand, in the photoreceptor according to this exemplary embodiment, the above Expression (1) is satisfied, that is, an appropriate amount of fluorine resin particles aggregated in an appropriate size are present on the surface of the photoreceptor. Accordingly, it is inferred that when the fluorine resin particles migrate to the surface of the photoreceptor, the particles are effectively accumulated on a cleaning member such as a cleaning blade, and the fluorine resin particles are extended and form a film on the surface of the photoreceptor. As a result, it is assumed that the efficiency of the transfer of a toner from the photoreceptor is improved in an initial stage in which image formation is started using the photoreceptor.

When the value of (A)/(B) is less than 0.5, the amount of fluorine resin particles aggregated in an appropriate size is small, whereby good transfer efficiency is not initially obtained. On the other hand, when the value of (A)/(B) is greater than 10, the amount of fluorine resin particles aggregated is too large. Accordingly, the light that is incident in the formation of a latent image is scattered, and as a result, image defects are generated such as formation of a blurred image.

The value of (A)/(B) is preferably from 2 to 10, and more preferably from 4 to 10.

(C)/(D)

Streaks in a circumferential direction of the photoreceptor are particularly formed in an initial stage in which image formation is started using the photoreceptor. From such a point of view, it is required to satisfy the above Expression (1)

on the outer surface of the outermost surface layer, but a preferable condition for the inside of the outermost surface layer is different from Expression (1).

Specifically, the state of fluorine resin particles contained in a part of 0.2 μm to 5 μm inside the surface of the outermost surface layer preferably satisfies the following Expression (2):

$$0.1 \leq (C)/(D) \leq 3 \quad \text{Expression (2)}$$

wherein (C) represents a number of aggregated particles in which 2 to 5 fluorine resin particles are connected and aggregated, and (D) represents a number of fluorine resin particles that are isolated without being aggregated.

When the value of (C)/(D) is 0.1 or greater, fluorine resin particles aggregated in an appropriate size are also dispersed inside the surface layer, and thus good transfer efficiency is obtained even when time has elapsed. As a result, the fine line reproducibility in an image obtained is excellent even when time has elapsed. When the value of (C)/(D) is 3 or less, an amount of fluorine resin particles aggregated is appropriate also inside the surface layer. Accordingly, the light that is incident in the formation of a latent image is suppressed from being scattered, and as a result, image defects such as formation of a blurred image are suppressed from being generated.

The value of (C)/(D) is more preferably from 0.2 to 3, and even more preferably from 0.5 to 2.

(E21) and (E6)

In the observation of the outer surface of the outermost surface layer, the number (E21) of aggregated particles in which 21 or more fluorine resin particles are connected and aggregated is preferably 5 or less, and more preferably 2 or less. It is preferable that the above number of aggregated particles be close to 0.

When the above (E21) is adjusted to the above range, fluorine resin particles are suppressed from being aggregated in too large a size on the outer surface of the outermost surface layer, and thus the light that is incident in the formation of a latent image is suppressed from being scattered, and image defects such as formation of a blurred image are thus suppressed from being generated.

In addition, in the observation of a part of 0.2 μm to 5 μm inside a surface layer from the outer surface in a cross-section in a depth direction of the outermost surface layer, the number (E6) of aggregated particles in which 6 or more fluorine resin particles are connected and aggregated is preferably 5 or less, and more preferably 2 or less. It is preferable that the above number of aggregated particles be close to 0.

When the above (E6) is adjusted to the above range, fluorine resin particles are suppressed from being aggregated in a too large size inside the outermost surface layer. Accordingly, the light that is incident in the formation of a latent image is suppressed from being scattered, and image defects such as formation of a blurred image are thus suppressed from being generated.

Methods of Calculating (A)/(B), (C)/(D), (E21), and (E6)

In the measurement of the above (A), (B), and (E21) on the outer surface of the outermost surface layer, the outermost surface layer and a layer immediately under the outermost surface layer are peeled off from a photoreceptor and a small piece is cut out. Then, a surface thereof is photographed using a laser microscope and the photograph is subjected to image processing for calculation (image region: 60.38 μm×45.47 μm).

In addition, in the measurement of the above (C), (D)), and (E6), a part of 0.2 μm to 5 μm inside the surface of the outermost surface layer, a 0.2 μm surface part is scraped off from the surface of a small piece cut out. Then, it is embedded with an epoxy resin and solidified, and using a microtome, a cut piece is prepared and set as a measurement sample. A cross-section thereof is photographed using a laser microscope and the photograph is subjected to image processing for calculation.

Control Method

The aggregation degree of fluorine resin particles on the outermost surface layer is controlled by adjusting the type of a dispersion aid to be used and the amount thereof, and also controlled in accordance with temperature and time conditions in drying in the formation of the outermost surface layer.

In addition, as a method of controlling the aggregation degree of fluorine resin particles on the surface of the outermost surface layer and the aggregation degree of fluorine resin particles inside the outermost surface layer, respectively, that is, as a method for satisfying the above Expressions (1) and (2), drying in the formation of the outermost surface layer is divided into two or more stages, and temperature and time conditions of the respective stages are changed.

Configuration of Photoreceptor

The photoreceptor according to this exemplary embodiment has a substrate and a photosensitive layer, and the outermost surface layer satisfies the above Expression (1).

Here, the photosensitive layer according to this exemplary embodiment may be a function-integrated photosensitive layer having both of a charge transport ability and a charge generation ability, or may be a function-separated photosensitive layer including a charge transport layer and a charge generation layer. Furthermore, other layers such as an undercoat layer and a surface protective layer may be provided.

Hereinafter, although the configuration of the photoreceptor according to this exemplary embodiment will be described with reference to FIGS. 1 to 3, this exemplary embodiment is not limited by FIGS. 1 to 3.

FIG. 1 is a schematic cross-sectional view illustrating an example of the layer configuration of the photoreceptor according to this exemplary embodiment. In FIG. 1, 1 represents a substrate, 2 represents a photosensitive layer, 2A represents a charge generation layer, 2B represents a charge transport layer, 4 represents an undercoat layer, and 5 represents a protective layer.

The photoreceptor shown in FIG. 1 has a layer configuration in which an undercoat layer 4, a charge generation layer 2A, a charge transport layer 2B, and a protective layer 5 are laminated in this order on a substrate 1, and a photosensitive layer 2 is formed of two layers, that is, the charge generation layer 2A and the charge transport layer 1B.

In the photoreceptor shown in FIG. 1, the protective layer 5 is an outermost surface layer.

Figure 2:
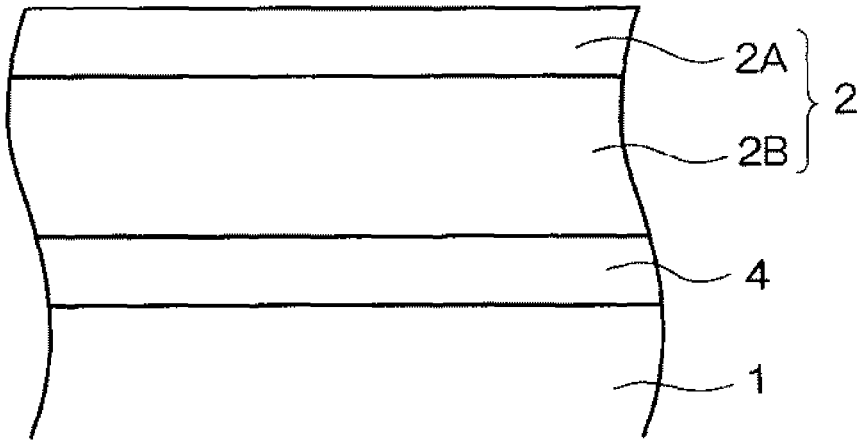
FIG. 2 is a partial cross-sectional view schematically illustrating an electrophotographic photoreceptor according to a second aspect of the exemplary embodiment.

FIG. 2 is a schematic cross-sectional view illustrating another example of the layer configuration of the photoreceptor according to this exemplary embodiment. In FIG. 2, 1 represents a substrate, 2 represents a photosensitive layer, 2A represents a charge generation layer, 2B represents a charge transport layer, and 4 represents an undercoat layer.

The photoreceptor shown in FIG. 2 has a layer configuration in which an undercoat layer 4, a charge generation layer 2A, and a charge transport layer 2B are laminated in this order on a substrate 1, and a photosensitive layer 2 is formed of two layers, that is, the charge generation layer 2A and the charge transport layer 2B.

In the photoreceptor shown in FIG. 2, the charge transport layer 2B is an outermost surface layer.

Figure 3:
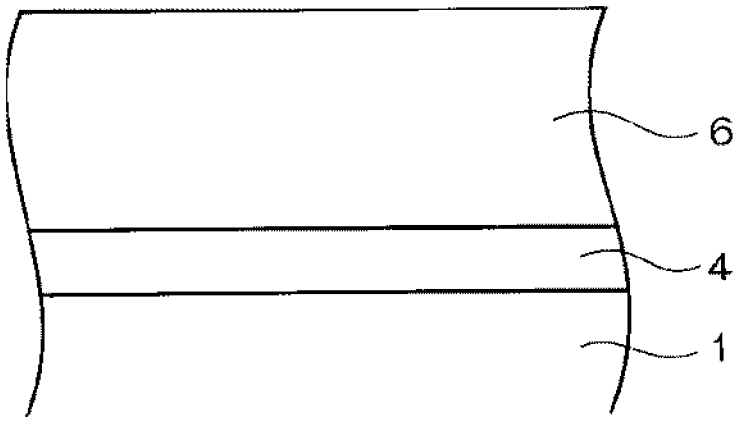
FIG. 3 is a partial cross-sectional view schematically illustrating an electrophotographic photoreceptor according to a third aspect of the exemplary embodiment.
Figure 4:
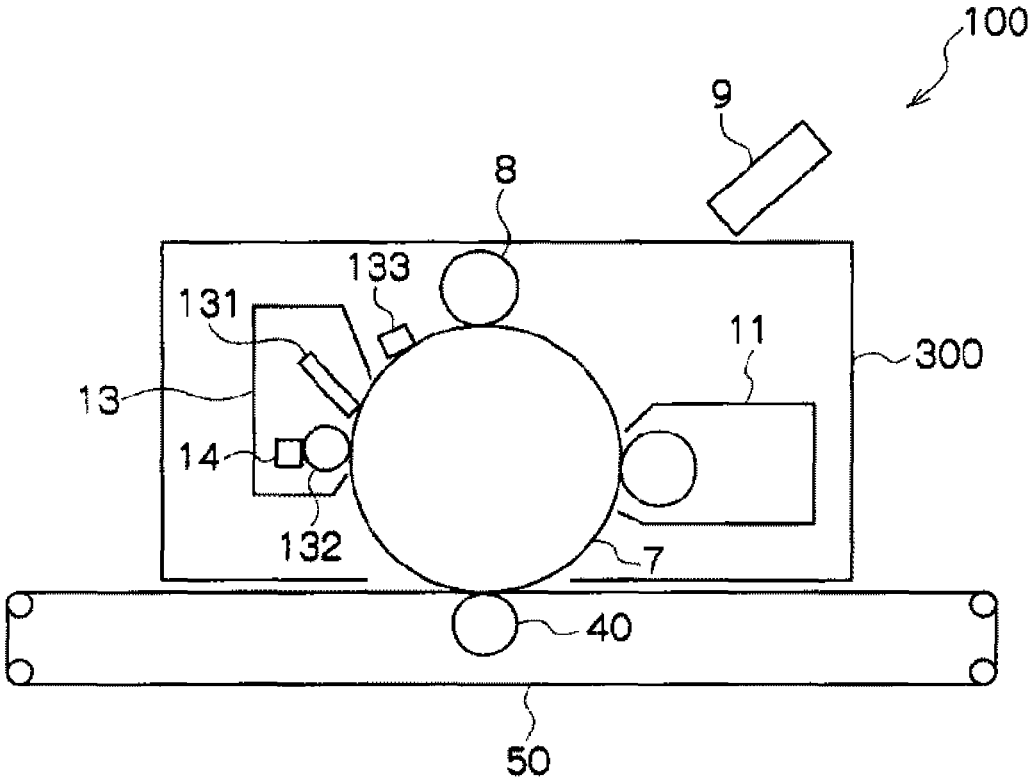
FIG. 4 is a diagram schematically illustrating the configuration of an image forming apparatus according to an exemplary embodiment.

FIG. 3 is a schematic cross-sectional view illustrating a further another example of the layer configuration of the photoreceptor according to this exemplary embodiment. In FIG. 3, 6 represents a function-integrated photosensitive layer, and other layer configuration is the same as in FIG. 1.

The photoreceptor shown in FIG. 3 has a layer configuration in which an undercoat layer 4 and a photosensitive layer 6 are laminated in this order on a substrate 1, and the photosensitive layer 6 is a layer in which the functions of the charge generation layer 2A and the charge transport layer 2B shown in FIG. 1 are integrated.

In the photoreceptor shown in FIG. 3, the function-integrated photosensitive layer 6 is an outermost surface layer.

Hereinafter, the respective layers of the photoreceptor according to this exemplary embodiment will be described using the photoreceptor shown in FIG. 1 as a representative example.

First Aspect

As shown in FIG. 1, a photoreceptor according to a first aspect has a layer configuration in which an undercoat layer 4, a charge generation layer 2A, a charge transport layer 2B, and a protective layer 5 are laminated in this order on a substrate 1, and the protective layer 5 is a surface protective layer.

Substrate

As the substrate 1, a conductive substrate is used, for example, a metal plate, a metal drum, and a metal belt obtained from metals such as aluminum, copper, zinc, stainless steel, chromium, nickel, molybdenum, vanadium, indium, gold, and platinum, or alloys thereof; and a paper, a plastic film, and a belt in which conductive compounds such as a conductive polymer and indium oxide or metals such as aluminum, palladium, and gold or alloys thereof are coated, deposited, or laminated. In this case, "conductive" indicates the volume resistivity being less than $10^{13}$ Ωcm.

When the photoreceptor according to the first aspect is used for a laser printer, it is preferable that the center line average roughness Ra of the substrate 1 be from 0.04 μm to 0.5 μm for the surface to be rough. However, when incoherent light is used as a light source, it is not particularly necessary for the surface to be rough.

Preferable examples of a method of obtaining a rough surface include wet honing of spraying a suspension, in which abrasive powder is suspended in water, onto a substrate; centerless grinding of bringing a rotating grindstone into contact with a substrate and continuously grinding the substrate; and anode oxidation.

In addition, another preferable example of a method of obtaining a rough surface includes a method in which conductive or semi-conductive particles are dispersed in a resin to form a layer on the surface of the substrate 4 and thus a rough surface is obtained by the particles dispersed in the layer without making the surface of the substrate 4 rough.

In this case, a rough surface treatment using anode oxidation is to form an oxide film on an aluminum surface by performing anode oxidation in an electrolyte solution using aluminum as an anode. Examples of the electrolyte solution include a sulfuric acid solution and an oxalate solution. However, a porous anodic oxide film obtained through anode oxidation is chemically reactive as it is. Therefore, it is preferable that a sealing treatment be performed to seal pores of the anodic oxide film by volume expansion caused by a hydration reaction in steam under pressure or in boiling water (to which a salt of a metal such as nickel may be added) and to obtain hydrous oxide.

It is preferable that the thickness of the anodic oxide film be from 0.3 μm to 15 μm.

In addition, a treatment using an acid aqueous solution or a boehmite treatment may be performed on the substrate 1.

The process using an acidic treatment solution containing phosphoric acid, chromic acid, and hydrofluoric acid is performed as follows. First, an acidic treatment solution is prepared. As the mixing ratio of phosphoric acid, chromic acid, and hydrofluoric acid in the acidic treatment solution, it is preferable that from 10% by weight to 11% by weight of phosphoric acid, from 3% by weight to 5% by weight of chromic acid, and from 0.5% by weight to 2% by weight of hydrofluoric acid be mixed and the concentration of all of these acids be from 13.5% by weight to 18% by weight. It is preferable that the treatment temperature be from 42° C. to 48° C. It is preferable that the thickness of the coating layer is from 0.3 μm to 15 μm.

The boehmite treatment is performed by dipping the substrate in pure water at 90° C. to 100° C. for 5 minutes to 60 minutes or by bringing the substrate into contact with heated steam at 90° C. to 120° C. for 5 minutes to 60 minutes. It is preferable that the thickness of the coating layer be from 0.1 μm to 5 μm. Furthermore, anode oxidation using an electrolyte solution having lower coating-film solubility than that of the other kinds, such as adipic acid, boric acid, borate, phosphate, phthalate, maleate, benzoate, tartrate, and citrate, may follow.

Undercoat Layer

The undercoat layer 4 is configured as a layer which contains inorganic particles in a binder resin.

It is preferable that the inorganic particles have a powder resistance (volume resistivity) of $10^2$ Ω·cm to $10^{11}$ Ω·cm.

Among these, as the inorganic particles having the above-described resistance value, inorganic particles (conductive metal oxide) of tin oxide, titanium oxide, zinc oxide, zirconium oxide, or the like are preferable, and inorganic particles of zinc oxide is particularly preferable.

In addition, the surfaces of the inorganic particles may be treated, or a mixture of two or more kinds of inorganic particles which are subjected to different surface treatments or have different particle sizes, may be used. The volume average particle size of the inorganic particles is preferably from 50 nm to 2000 nm (more preferably from 60 nm to 1000 nm).

In addition, it is preferable that the BET specific surface area of the inorganic particles be greater than or equal to 10 $m^2/g$.

In addition to the inorganic particles, the undercoat layer may further include an acceptor compound. Any acceptor compounds may be used, and preferable examples thereof include electron transport materials such as quinone compounds (for example, chloranil and bromanil), tetracyanoquinodimethane compounds, fluorenone compounds (for example, 2,4,7-trinitrofluorenone and 2,4,5,7-tetranitro-9-fluorenone), oxadiazole compounds (for example, 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)1,3,4-oxadiazole), xanthone compounds, thiophene compounds, and diphenoquinone compounds (for example, 3,3',5,5-tetra-t-butyldiphenoquinone). In particular, compounds having an anthraquinone structure are preferable. Furthermore, acceptor compounds having an anthraquinone structure such as hydroxyanthraquinone compounds, aminoanthraquinone compounds, and aminohydroxyanthraquinone compounds are preferable, and specific examples thereof include anthraquinone, alizarin, quinizarin, anthrarufin, and purpurin.

The content of the acceptor compound is not limited, and is preferably from 0.01% by weight to 20% by weight with respect to the inorganic particles. It is more preferable that the content be from 0.05% by weight to 10% by weight.

The acceptor compound may be added at the time of the coating of the undercoat layer 1 or may be attached to the surfaces of the inorganic particles in advance. Examples of attaching the acceptor compound to the surfaces of the inorganic particles include a dry method and a wet method.

When the surfaces are treated according to the dry method, the acceptor compound is added dropwise directly or after being dissolved in an organic solvent while the inorganic particles are stirred with a mixer or the like having a large shearing force, followed by spraying along with dry air or nitrogen gas. It is preferable that adding or spraying is performed at a temperature lower than the boiling temperature of the solvent. After adding and spraying, baking may follow at 10° C. or higher. The temperature and the time of baking are not particularly limited.

When the surfaces are treated according to the wet method, the inorganic particles are stirred in a solvent and dispersed with ultrasonic waves, a sand mill, an attritor, a ball mill, or the like, the acceptor compound is added and stirred or dispersed, and the solvent is removed. The solvent is removed by filtration or distillation. After the solvent is removed, baking may follow at 100° C. or higher. The temperature and the time of baking are not particularly limited. In the wet method, before a surface treatment agent is added, inorganic-particle-containing aqueous ingredients may be removed. Examples of a removal method include a method of removing the aqueous ingredients while being stirred and heated in a solvent used for the surface treatment and a method of removing the aqueous ingredients by azeotroping them with a solvent.

In addition, the surfaces of the inorganic particle may be treated before adding the acceptor compound. The surface treatment agent may be selected from well-known materials. Examples thereof include a silane coupling agent, a titanate coupling agent, an aluminum coupling agent, and a surfactant. In particular, a silane coupling agent is preferable. Furthermore, a silane coupling agent having an amino group is more preferable.

Any silane coupling agents having an amino group may be used, and specific examples thereof include γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane. However, the coupling agent having an amino group is not limited thereto.

In addition, a mixture of two or more kinds of silane coupling agents may be used. Examples of a silane coupling agent which may be used in combination with the silane coupling agent having an amino group include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. However, the silane coupling agent is not limited thereto.

As the surface treatment method, any well-known methods may be used, but a dry method or a wet method is preferable. In addition, the addition of the acceptor compound and the surface treatment using a coupling agent may be performed at the same time.

The amount of the silane coupling agent with respect to the inorganic particles in the undercoat layer 1 is not particularly limited, but is preferably from 0.5% by weight to 10% by weight with respect to the inorganic particles.

As the binder resin included in the undercoat layer 1, any well-known resins may be used, and examples thereof include well-known polymer resin compounds such as acetal resins (for example, polyvinyl butyral), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, and urethane resins; charge transport resins having a charge transport group; and conductive resins such as polyaniline. Among these, resins which are insoluble in a coating solvent of an upper layer are preferably used, and particularly preferable examples thereof include phenolic resins, phenol-formaldehyde resins, melamine resins, urethane resins, and epoxy resins. These examples may be used in combination of two or more kinds and the mixing ratio thereof is optionally set.

The ratio of the metal oxide imparted with an accepting property and the binder resin or the ratio of the inorganic particles and the binder resin in the undercoat-layer-forming coating solution is not particularly limited.

Various additives may be added to the undercoat layer 1. As the additives, well-known materials such as electron transport pigments, (for example, condensed polycyclic pigments and azo pigments), zirconium chelate compounds, titanium chelate compounds, aluminum chelate compounds, titanium alkoxide compounds, organic titanium compounds, and silane coupling agents are used. The silane coupling agent is used for the surface treatment of the metal oxide, but may be further added to the coating solution as an additive. Specific examples of the silane coupling agent used as the additive include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, ethyl acetoacetate zirconium, zirconium triethanolamine, acetylacetonate zirconium butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butylate, ethyl acetoacetate aluminum diisopropylate, and aluminum tris(ethyl acetoacetate).

These compounds may be used alone or as a mixture or a polycondensate of plural kinds.

The solvent used for preparing the undercoat-layer-forming coating solution is selected from well-known organic solvents such as alcohols, aromatic solvents, halogenated hydrocarbons, ketones, ketone alcohols, ethers, and esters. Examples of the solvent include well-known organic solvents such as methanol, ethanol, n-propanol, iso-propanol, n-butanol, benzylalcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

In addition, as the solvent used for dispersion, the above examples may be used alone or as a mixture of two or more kinds. When a mixture of two or more kinds of solvents is used, any mixed solvents may be used as long as the binder resin is soluble therein.

Examples of a dispersion method include well-known methods using a roll mill, a ball mill, a vibration ball mill, an attritor, a sand mill, a colloid mill, and a paint shaker. Furthermore, examples of a coating method used for providing the undercoat layer 1 include well known methods such as a blade coating method, a wire-bar coating method, a spray coating method, a dip coating method, a bead coating method, an air knife coating method, and a curtain coating method.

Using the undercoat-layer-forming coating solution thus obtained, the undercoat layer 1 is formed on the substrate 4.

In addition, it is preferable that the undercoat layer 1 have a Vickers hardness of 35 or greater.

Furthermore, the thickness of the undercoat layer 1 is not limited, but it preferable that the thickness be greater than or equal to 5 μm and more preferably from 10 μm to 40 μm.

In addition, in order to prevent moire fringe, the surface roughness (the average of surface roughnesses at ten points) of the undercoat layer 1 is adjusted to be 1/4n (n represents the refractive index of an upper layer) to 1/2λ of the wavelength λ of exposure laser light to be used. In order to adjust the surface roughness, particles of a resin or the like may be added to the undercoat layer. Examples of the resin particles include silicone resin particles and cross-linked polymethylmethacrylate resin particles.

In addition, in order to adjust the surface roughness, the undercoat layer may be polished. Examples of a polishing method include buffing, sand blasting, wet honing, and grinding.

The undercoat layer may be obtained by coating and drying the coating solution. In this case, in general, drying is performed at a temperature that evaporates a solvent to form the layer.

Charge Generation Layer

It is preferable that the charge generation layer 2A at least include a charge generation material and a binder resin.

Examples of the charge generation material include azo pigments such as bisazo and trisazo, condensed aromatic pigments such as dibromoanthanthrone, perylene pigments, pyrrolopyrrole pigments, phthalocyanine pigments, zinc oxide, and trigonal selenium. Among these, for exposure laser light in the near-infrared range, metal phthalocyanine pigments and/or metal-free phthalocyanine pigments are preferable. In particular, hydroxygallium phthalocyanines disclosed in JP-A-5-263007 and JP-A-5-279591, chlorogallium phthalocyanine disclosed in JP-A-5-98181, dichlorotin phthalocyanines disclosed JP-A-5-140472 and JP-A-5-140473, and titanyl phthalocyanines disclosed in JP-A-4-189873 and JP-A-5-43823 are preferable. In addition, for laser light in the near-ultraviolet range, condensed aromatic pigments such as dibromoanthanthrone, thioindigo pigments, porphyrazine compounds, zinc oxide, and trigonal selenium are more preferable. As the charge generation material, when a light source which emits exposure light having a wavelength of 380 nm to 500 nm is used, inorganic pigments are preferable, and when a light source which emits exposure light having a wavelength of 700 nm to 800 nm is used, metal phthalocyanine pigments and metal-free phthalocyanine pigments are preferable.

As the charge generation material, in an absorption spectrum having a wavelength range of 600 nm to 900 nm, hydroxygallium phthalocyanine pigment having a maximum peak wavelength in a range of 810 nm to 839 nm is preferable. This hydroxygallium phthalocyanine pigment is different from V-type hydroxygallium phthalocyanine pigment of the related art and has a maximum peak wavelength which is shifted further to the short wavelength side than the related art in the absorption spectrum.

In addition, in the hydroxygallium phthalocyanine pigment having a maximum peak wavelength of 810 nm to 839 nm, it is preferable that the average particle size be in a specific range and the BET specific surface area be in a specific range. Specifically, the average particle size is preferably less than or equal to 0.20 μm and more preferably from 0.01 μm to 0.15 μm, and the BET specific surface area is preferably greater than or equal to 45 $m^2/g$, more preferably greater than or equal to 50 $m^2/g$, and still more preferably from 55 $m^2/g$ to 120 $m^2/g$. The average particle size is measured as a volume average particle size (d50 average particle size) using a laser diffraction scattering particle size distribution analyzer (LA-700, manufactured by HORIBA Ltd.). In addition, the BET specific surface area is measured using a BET specific surface area measuring instrument (manufactured by Shimadzu Corporation, FLOWSORB II2300) according to a nitrogen substitution method.

In addition, the maximum particle size (maximum value of primary particle sizes) of the hydroxygallium phthalocyanine pigment is preferably less than or equal to 1.2 μm, more preferably less than or equal to 1.0 μm, and still more preferably less than or equal to 0.3 μm.

Furthermore, in the hydroxygallium phthaocyanine pigment, it is preferable that the average particle size be less than or equal to 0.2 μm, the maximum particle size be less than or equal to 1.2 μm, and the BET specific surface area be greater than or equal to 45 $m^2/g$.

In addition, in an X-ray diffraction spectrum using CuKα characteristic X-rays, it is preferable that the hydroxygallium phthalocyanine pigment have diffraction peaks at Bragg angles (2θ±0.2°) of 7.5°, 9.9°, 12.5°, 16.3°, 18.6°, 25.1°, and 28.3°.

In addition, when the hydroxygallium phthalocyanine pigment is heated from 25° C. to 400° C., the decrease rate in thermogravimetry is preferably from 2.0% to 4.0% and more preferably from 2.5% to 3.8%.

The binder resin used for the charge generation layer 2 is selected from a wide range of insulating resins and may be selected from organic photoconductive polymers such as poly-N-vinyl carbazole, polyvinyl anthracene, polyvinyl pyrene, and polysilane. Preferable examples of the binder resin include polyvinyl butyral resins, polyarylate resins (for example, polycondensates of bisphenols and aromatic divalent carboxylic acids), polycarbonate resins, polyester resins, phenoxy resins, vinyl chloride-vinyl acetate copolymer, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. As the binder resins, the above examples may be used alone or as a mixture of two or more kinds. It is preferable that the mixing ratio of the charge generation material and the binder resin be from 10:1 to 1:10. In this case, "insulating" indicates the volume resistivity being greater than or equal to $10^{13}$ Ωcm.

The charge generation layer 2A is formed using, for example, a coating solution in which the charge generation material and the binder resin are dispersed in a solvent.

Examples of the solvent used for the dispersion include methanol, ethanol, n-propanol, n-butanol, benzylalcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. As the solvent, the above examples may be used alone or as a mixture of two or more kinds.

In addition, examples of a method of dispersing the charge generation material and the binder resin in a solvent include well-known methods such as a ball mill dispersion method, an attritor dispersion method, and a sand mill dispersion method. Furthermore, for this dispersion, it is effective when the average particle size of the charge generation material is preferably less than or equal to 0.5 μm, more preferably less than or equal to 0.3 μm, and still more preferably less than or equal to 0.15 μm.

In addition, the charge generation layer 2 is formed using a well-known method such as a blade coating method, a wire-bar coating method, a spray coating method, a dip coating method, a bead coating method, an air knife coating method, or a curtain coating method.

The thickness of the charge generation layer 2 thus obtained is preferably from 0.1 μm to 5.0 μm and more preferably from 0.2 μm to 2.0 μm.

Charge Transport Layer

The charge transport layer 3 is preferably a layer at least including a charge transport layer and a binder resin, or a layer including a polymer charge transport material.

Examples of the charge transport materials include electron transport compounds such as quinone compounds (such as p-benzoquinone, chloranil, bromanil, and anthraquinone) tetracyanoquinodimethane compounds, fluorenone compounds (for example, 2,4,7-trinitrofluorenone), xanthone compounds, benzophenone compounds, cyanovinyl compounds, and ethylene compounds; and hole transport compounds such as triarylamine compounds, benzidine compounds, arylalkane compounds, aryl-substituted ethylene compounds, stilbene compounds, anthracene compounds, or hydrazone compounds. As the charge transport materials, the above examples may be used alone or as a mixture of two or more kinds, but the charge transport materials are not limited thereto.

As the charge transport material, a triarylamine derivative represented by the following Structural Formula (c-1) and a benzidine derivative represented by the following Structural Formula (c-2) are preferable from the viewpoint of charge mobility.

(c-1)

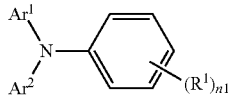

In Structural Formula (c-1), $R^1$ represents a methyl group. n1 represents 1 or 2. $Ar^1$ and $Ar^2$ each independently represent a substituted or unsubstituted aryl group, —$CH_1$—C($R^2$)═C($R^3$)($R^4$), or —$C_6H_4$—CH═CH—CH═C($R^5$)($R^6$), and $R^2$ to $R^6$ each independently represent a hydrogen atom, a substituted or unsubstituted alkyl group, or a substituted or unsubstituted aryl group. Examples of the substituent include a halogen atom, an alkyl group having from 1 to 5 carbon atoms, an alkoxy group having from 1 to 5 carbon atoms, or a substituted amino group substituted with an alkyl group having from 1 to 3 carbon atoms.

(c-2)

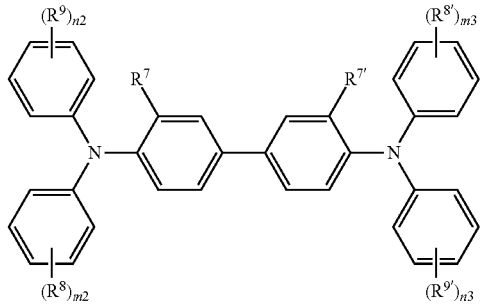

In Structural Formula (c-2), $R^7$ and $R^{7'}$ may be the same as or different from each other, and each independently represent a hydrogen atom, a halogen atom, an alkyl group having from 1 to 5 carbon atoms, or an alkoxy group having from 1 to 5 carbon atoms. $R^8$, $R^{8'}$, $R^9$ and $R^{9'}$ may be the same as or different from each other, and each independently represent a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, —C($R^{10}$)═C($R^{11}$)($R^{12}$), or —CH═CH—CH═C($R^{13}$)($R^{14}$), and $R^{10}$ to $R^{14}$ each independently represent a hydrogen atom, a substituted or unsubstituted alkyl group, or a substituted or unsubstituted aryl group. m2, m3, n2, and n3 each independently represent an integer of from 0 to 2.

Here, among triarylamine derivatives represented by the above Structural Formula (c-1) and benzidine derivatives represented by the above Structural Formula (c-2), a triarylamine derivative having "—$C_6H_4$—CH═CH—CH═C($R^5$)($R^6$)" and a benzidine derivative having "—CH═CH—H═C($R^{13}$)($R^{14}$)" are particularly preferable.

Examples of the binder resin used for the charge transport layer 2B (resin for the charge transport layer) include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymer, vinylidene chloride-acrylonitrile copolymer, vinyl chloride-vinyl acetate copolymer, vinyl chloride-vinyl acetate-maleic anhydride copolymer, silicone resins, silicone alkyd resins, phenol-formaldehyde resins, styrene-alkyd resins, poly-N-vinyl carbazole, and polysilane. In addition, as described above, polymer charge transport materials such as polyester-based polymer charge transport materials disclosed in JP-A-8-176293 and JP-A-B-208820 may be used. As the binder resin, the above examples may be used alone or as a mixture of two or more kinds. It is preferable that the mixing ratio of the charge transport materials and the binder resin be from 10:1 to 1:5.

The binder resin is not particularly limited, but at least one kind of polycarbonate resins having a viscosity average molecular weight of 50,000 to 80,000 and polyarylate resins having a viscosity average molecular weight of 50,000 to 80,000 is preferable.

In addition, as the charge transport materials, a polymer charge transport material may be used. As the polymer charge transport material, well-known materials having a charge transport function such as poly-N-vinylcarbazole and polysilane may be used. In particular, polyester-based polymer charge transport materials disclosed in JP-A-8-176293 and JP-A-8-208820 are preferable. The layer may be formed using the polymer charge transport material alone or a mixture of the polymer charge transport material and the binder resin described later.

Fluorine Resin Particles

When the charge transport layer 2B is an outermost surface layer as shown in FIG. 2 (that is, second aspect), fluorine resin particles are contained.

As the fluorine resin particles, one or two or more types selected from a tetrafluoroethylene resin (PTFE), a trifluoroethylene chloride resin, a hexafluoropropylene resin, a vinyl fluoride resin, a vinylidene fluoride resin, a difluorodichloroethylene resin, and copolymers thereof are used. A tetrafluoroethylene resin and a vinylidene fluoride resin are more preferable, and a tetrafluoroethylene resin is particularly preferable.

The average primary particle diameter of the fluorine resin particles used is preferably from 0.05 μm to 1 μm, and more preferably from 0.1 μm to 0.5 μm.

The average primary particle diameter of the fluorine resin particles is a value that is measured at a refractive index of 1.35 using a laser diffraction-type particle size distribution measurement apparatus LA-700 (manufactured by Horiba, Ltd.) with a measurement liquid obtained by dilution with the same solvent as that of a dispersion in which the fluorine resin particles are dispersed.

Dispersion Aid

First, "dispersion aid" of the fluorine resin particles is a compound that functions to improve the dispersibility of the fluorine resin particles such as PTFE particles, maintains absorptivity to the surfaces of the fluorine resin particles, and may retain compatibility with the binder resin contained in the outermost surface layer.

Examples of the dispersion aid include fluorine surfactants, fluorine polymers, silicone polymers, and silicone oils. Among them, fluorine polymers, especially fluorine comb-type graft polymers are preferable, and as the fluorine comb-type graft polymers, resins graft-polymerized with a macromonomer selected from an acrylic acid ester compound, a methacrylic acid ester compound, and a styrene compound and perfluoroalkylethyl methacrylate are preferable.

Among them, a fluorinated alkyl group-containing copolymer (hereinafter, may be simply referred to as "specific copolymer") including repeating units represented by the following Structural Formula D and the following Structural Formula E is preferable.

Structural Formula D

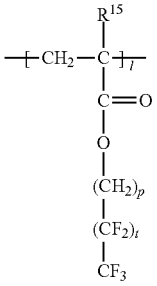

-continued

Structural Formula E

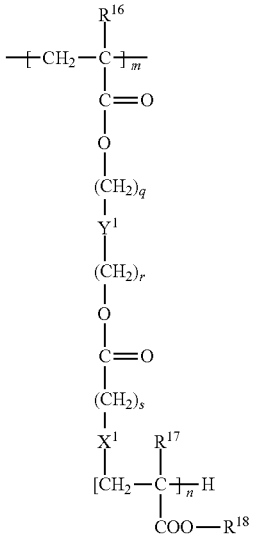

In Structural Formula D and Structural Formula E, l, m, and n represent an integer of 1 or greater, p, q, r, and s represent 0 or an integer of 1 or greater, t represents an integer of 1 to 7, $R^{15}$, $R^{16}$, $R^{17}$, and $R^{18}$ represent a: hydrogen atom or an alkyl group, $X^1$ represents an alkylene chain, a halogen-substituted alkylene chain, —S—, —O—, —NH—, or a single bond, $Y^1$ represents an alkylene chain, a halogen-substituted alkylene chain, —($C_zH_{2z-1}$(OH))—, or a single bond, and z represents an integer of 1 or greater.

The specific copolymer includes the repeating units represented by the above Structural Formula D and the above Structural Formula E. However, since t in Structural Formula D is from 1 to 7, absorptivity of the fluorine graft polymer (that is, the above specific copolymer) to the fluorine resin particles is maintained, and compatibility with the binder resin contained in the surface layer is retained. t in Structural Formula D is more preferably from 2 to 6.

The specific copolymer is a fluorine graft polymer including repeating units represented by Structural Formula D and Structural Formula E, and is a resin synthesized by, for example, graft polymerization using a macromonomer formed of an acrylic acid ester compound, a methacrylic acid ester compound, or the like, perfluoroalkylethyl(meth)acrylate, and perfluoroalkyl(meth)acrylate. Here, (meth)acrylate represents acrylate or methacrylate.

In the specific copolymer, the content ratio of Structural Formula D to Structural Formula E, that is, a ratio of l:m is preferably 1:9 to 9:1, and more preferably 3:7 to 7:3.

In Structural Formula D and Structural Formula E, examples of the alkyl group represented by $R^{15}$, $R^{16}$, $R^{17}$, and $R^{18}$ include a methyl group, an ethyl group, and a propyl group. As $R^{15}$, $R^{16}$, $R^{17}$, and $R^{18}$, a hydrogen atom and a methyl group are preferable, and among them, a methyl group is more preferable.

In the charge transport layer 2B (that is, charge transport layer 2B in the second aspect) that is the outermost surface layer shown in FIG. 2, the content of the specific copolymer is preferably from 1% by weight to 5% by weight with respect to the content of the fluorine resin particles in the outermost surface layer (weight base).

The content of the fluorine resin particles with respect to the total solid content of the charge transport layer 2B that is the outermost surface layer is preferably from 1% by weight to 15% by weight, and more preferably from 2% by weight to 12% by weight, with respect to the surface layer.

The charge transport layer 2B is formed using, for example, a coating liquid for charge transport layer formation containing the above constituent materials. As a solvent for use in the coating liquid for charge transport layer formation, normal organic solvents such as aromatic hydrocarbons, e.g., benzene, toluene, xylene, and chlorobenzene, ketones, e.g., acetone and 2-butanone, halogenated aliphatic hydrocarbons, e.g., methylene chloride, chloroform, and ethylene chloride, and cyclic or linear ethers, e.g., tetrahydrofuran and ethyl ether are used singly or in mixture of two or more types. In addition, a known method is used as a method of dispersing the constituent materials.

As a coating method that is used when the charge generation layer 2A is coated with the coating liquid for charge transport layer formation, a normal method such as a blade coating method, a wire bar coating method, a spray coating method, a dipping coating method, a bead coating method, an air knife coating method, or a curtain coating method is used.

The thickness of the charge transport layer 2B is preferably from 5 μm to 50 μm, and more preferably from 10 μm to 30 μm.

Surface Protective Layer (Protective Layer)

The protective layer 5 as a surface protective layer in the first aspect contains fluorine resin particles.

As the fluorine resin particles, the particles exemplified in the description of the charge transport layer 2B are preferably used. In addition, a dispersion aid may be used in combination, and the aids exemplified in the description of the charge transport layer 2B are preferably used.

The content of a charge-transporting material in the protective layer 5 is preferably from 90% by weight to 98% by weight, and more preferably from 90% by weight to 95% by weight.

From such a viewpoint, the content of the fluorine resin particles is preferably from 2% by weight to 10% by weight, and more preferably from 5% by weight to 10% by weight.

In addition, the protective layer 5 in the first aspect preferably contains a cross-linked substance formed by cross-linking a compound having a guanamine structure or a melamine structure with a charge-transporting material.

First, a compound having a guanamine structure (guanamine compound) will be described.

The guanamine compound is a compound having a guanamine skeleton (structure). Examples thereof include acetoguanamine, benzoguanamine, formoguanamine, steroguanamine, spiroguanamine, and cyclohexylguanamine.

Particularly, the guanamine compound is preferably at least one kind of compounds represented by the following Formula (A) and oligomers thereof. Here, the oligomer is an oligomer in which the compound represented by Formula (A) is polymerized as a structural unit, and the polymerization degree thereof is, for example, from 2 to 200 (preferably from 2 to 100). The compounds represented by Formula (A) may be used singly or in combination with two or more types.

Formula (A)

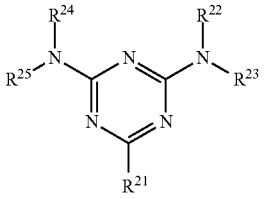

In Formula (A), $R^{21}$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. $R^{22}$ to $R^{25}$ each independently represent a hydrogen atom, —$CH_2$—OH, or —$CH_2$—O—$R^{26}$. $R^{26}$ represents a linear or branched alkyl group having from 1 to 10 carbon atoms.

In Formula (A), the alkyl group represented by $R^{21}$ has from 1 to 10 carbon atoms, preferably from 1 to 8 carbon atoms, and more preferably from 1 to 5 carbon atoms. The alkyl group may be linear or branched.

In Formula (A), the phenyl group represented by $R^{21}$ has from 6 to 10 carbon atoms, and preferably from 6 to 8 carbon atoms. Examples of the substituent of the substituent of the phenyl group include a methyl group, an ethyl group, and a propyl group.

In Formula (A), the alicyclic hydrocarbon group represented by $R^{21}$ has from 4 to 10 carbon atoms, and preferably from 5 to 8 carbon atoms. Examples of the substituent of the alicyclic hydrocarbon group include a methyl group, an ethyl group, and a propyl group.

In Formula (A), in "—$CH_2$—O—$R^{26}$" represented by $R^{22}$ to $R^{25}$, the alkyl group represented by $R^{26}$ has from 1 to 10 carbon atoms, preferably from 1 to 8 carbon atoms, and more preferably from 1 to 6 carbon atoms. In addition, the alkyl group may be linear or branched. Preferable examples thereof include a methyl group, an ethyl group, and a butyl group.

The compound represented by Formula (A) is particularly preferably a compound in which $R^{21}$ represents a substituted or unsubstituted phenyl group having from 6 to 10 carbon atoms, and $R^{22}$ to $R^{25}$ each independently represent —$CH_2$—O—$R^{26}$. $R^{26}$ is preferably selected from a methyl group and an n-butyl group.

The compound represented by Formula (A) is synthesized by, for example, a known method using guanamine and formaldehyde (for example, see Experimental Chemical Lecture, $4^{th}$ Edition, vol. 28, p. 430).

Hereinafter, specific examples of the compound represented by Formula (A) will be shown, but are not limited thereto. In addition, although the following specific examples are in the form of a monomer, the compounds may be oligomers having these monomers as a structural unit.

(A)-1

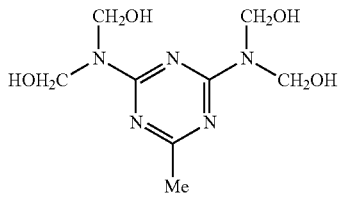

(A)-2

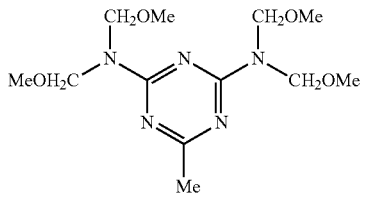

-continued
(A)-3
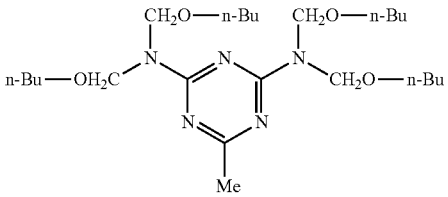
(A)-4
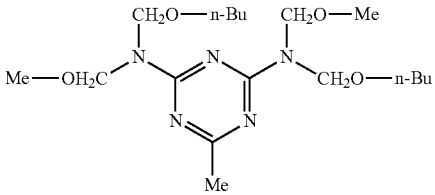
(A)-5
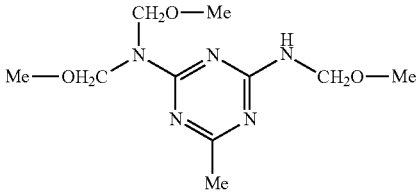
(A)-6
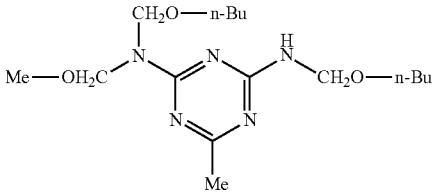
(A)-7
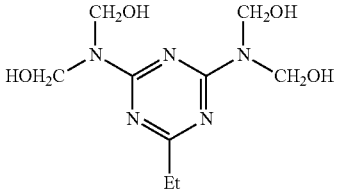
(A)-8
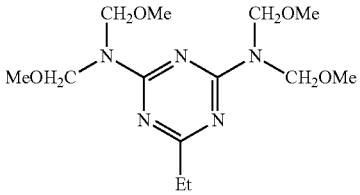
(A)-9
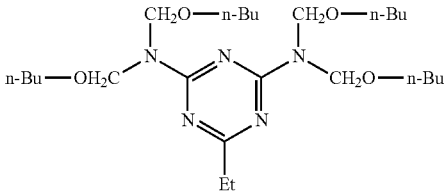
(A)-10
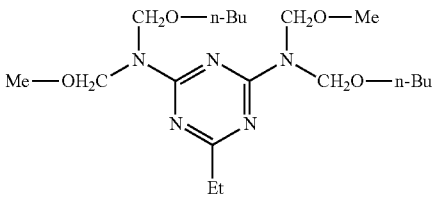
-continued
(A)-11
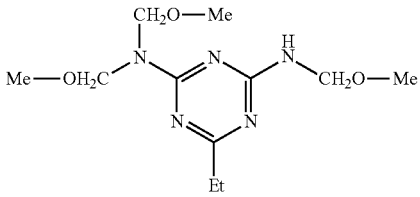
(A)-12
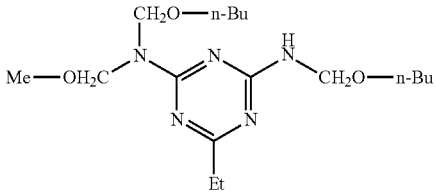
(A)-13
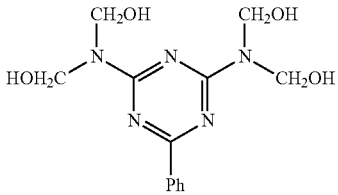
(A)-14
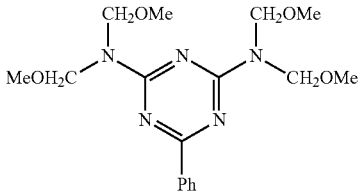
(A)-15
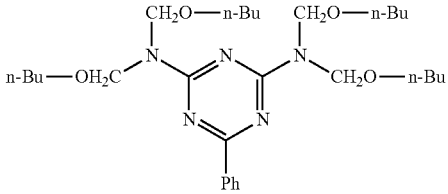
(A)-16
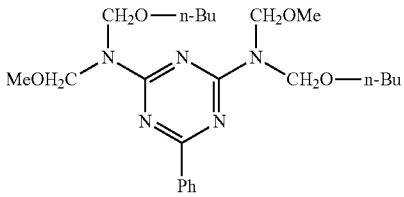
(A)-17
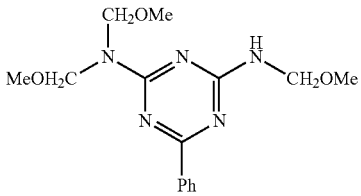
(A)-18
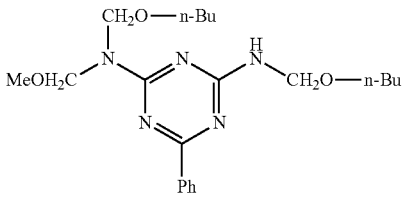

-continued
(A)-19
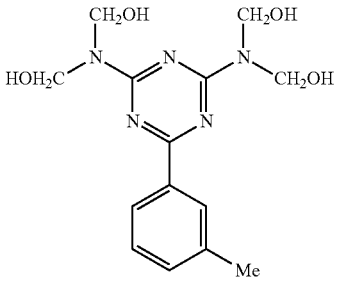
(A)-20
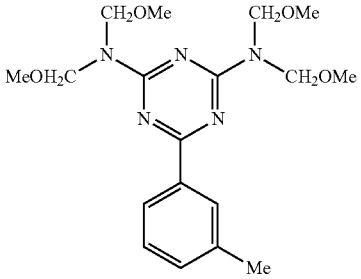
(A)-21
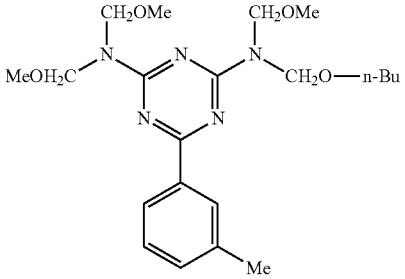
(A)-22
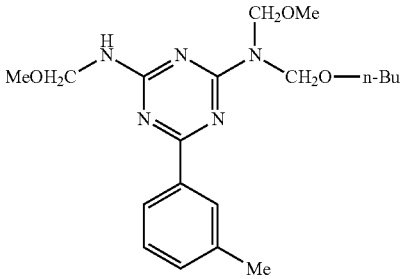
(A)-23
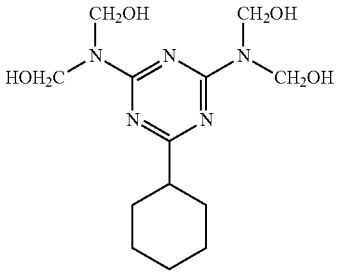
-continued
(A)-24
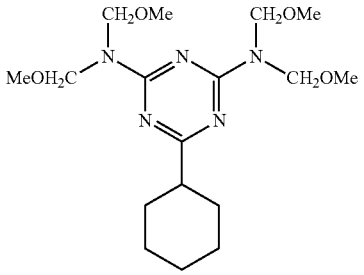
(A)-25
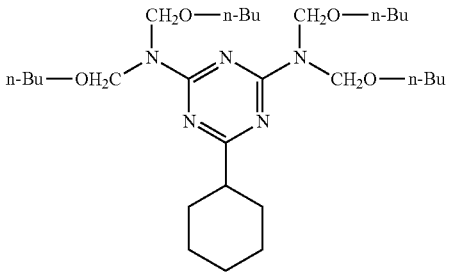
(A)-26
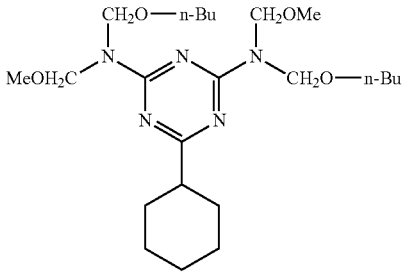
(A)-27
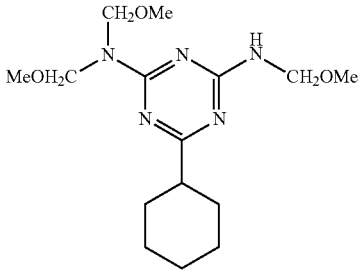
(A)-28
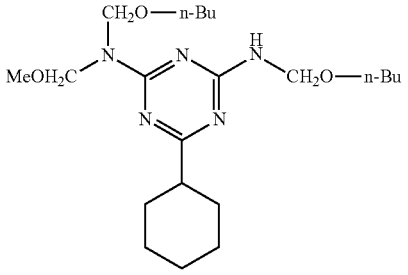

-continued
(A)-29
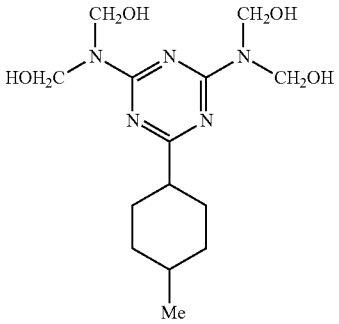
(A)-30
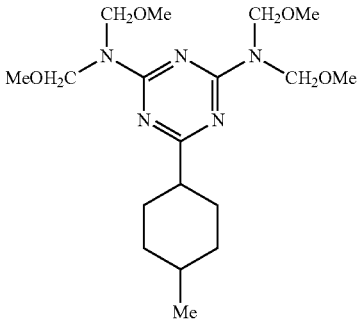
(A)-31
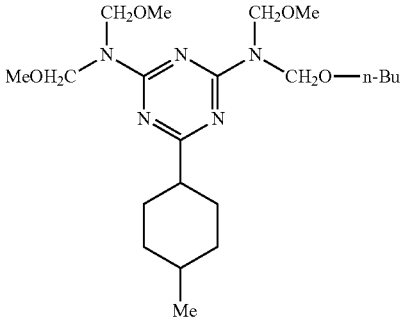
(A)-32
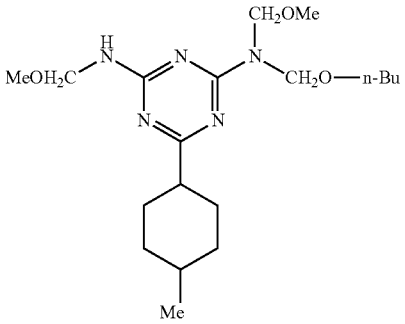
(A)-33
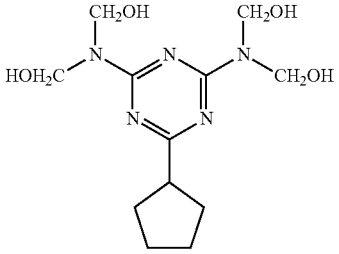
-continued
(A)-34
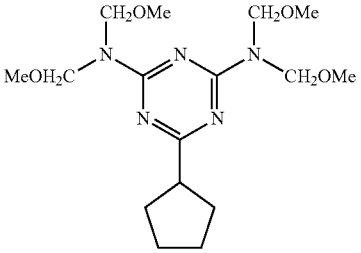
(A)-35
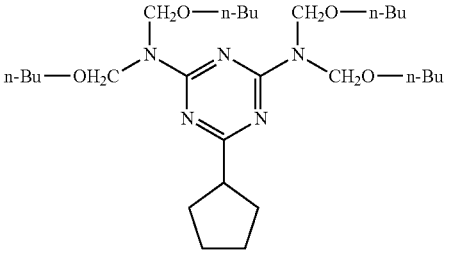
(A)-36
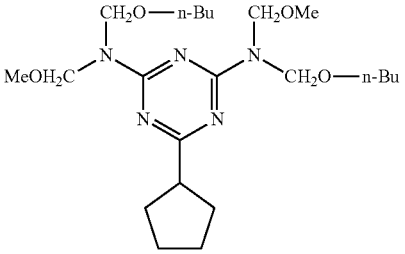
(A)-37
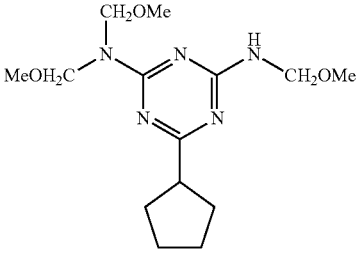
(A)-38
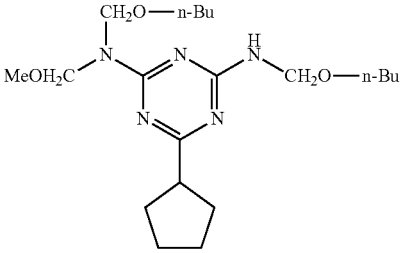
(A)-39
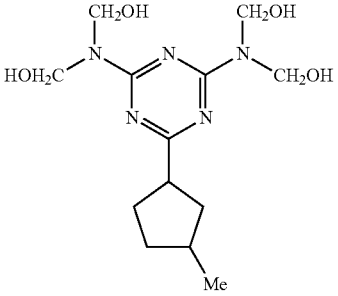

-continued (A)-40

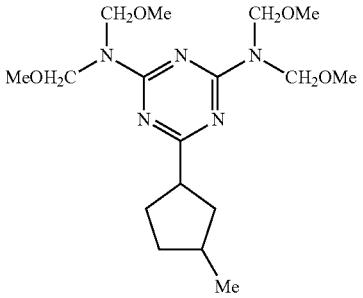

(A)-41

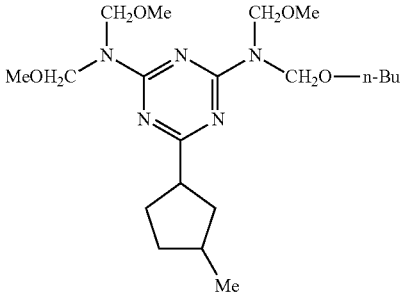

(A)-42

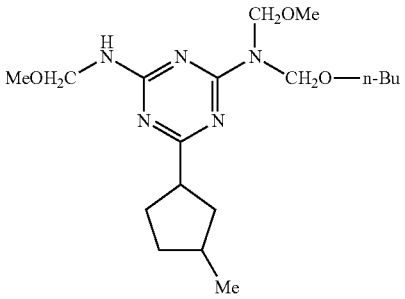

Examples of the commercially available product of the compound represented by Formula (A) include SUPER BECKAMINE® L-148-55, SUPER BECKAMINE® 13-535, SUPER BECKAMINE® L-145-60, and SUPER BECKAMINE® TD-2 (all manufactured by DIC Corporation); and NIKALAC BL-60, and NIKALAC BX-4000 (all manufactured by Nippon Carbide Industries Co., Inc.).

In addition, the compound represented by Formula (A) (including oligomers) may be dissolved in an appropriate solvent such as toluene, zylene or ethyl acetate, and washed with distilled water, ion exchange water or the like, or may be treated with an ion exchange resin, in order to remove the effect of a residual catalyst after synthesizing or purchasing the commercially available product.

Next, a compound having a melamine structure (melamine compound) will be described.

The melamine compound has a melamine skeleton (structure), and is particularly preferably at least one kind of compounds represented by the following Formula (B) and oligomers thereof. Here, the oligomer is obtained by polymerizing the compound represented by Formula (B) as a structural unit as in the case of the compound represented by Formula (A), and the polymerization degree thereof is, for example, from 2 to 200 (preferably from 2 to 100). The compounds represented by Formula (B) or oligomers thereof may be used singly or in combination with two or more types. In addition, the compounds represented by Formula (B) or oligomers thereof may be used in combination with compounds represented by Formula (A) or oligomers thereof.

Formula (B)

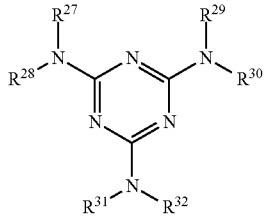

In Formula (B), $R^{27}$ to $R^{32}$ each independently represent a hydrogen atom, —$CH_2$—OH, or —$CH_2$—O—$R^{33}$, and $R^{33}$ represents an alkyl group having from 1 to 5 carbon atoms that may be branched. Examples of the alkyl group represented by $R^{33}$ include a methyl group, an ethyl group, and a butyl group.

The compound represented by Formula (B) is synthesized by, for example, a known method using melamine and formaldehyde (for example, in the same manner as in the case of the melamine resin as described in Experimental Chemical Lecture, $4^{th}$ Edition, vol. 28, p. 430).

Hereinafter, specific examples of the compound represented by Formula (B) will be shown, but are not limited thereto. Although the following specific examples are in the form of a monomer, the compounds may be oligomers having these monomers as a structural unit.

(B)-1

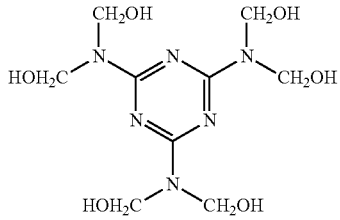

(B)-2

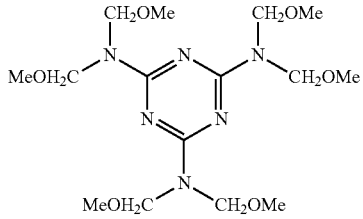

(B)-3

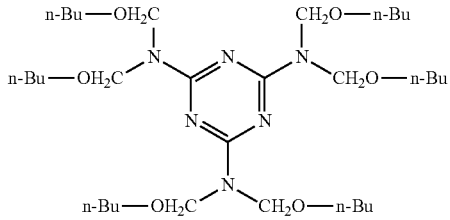

(B)-4

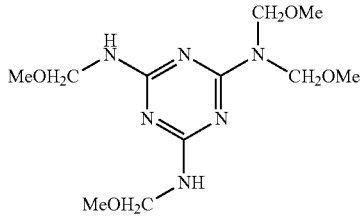

-continued (B)-5

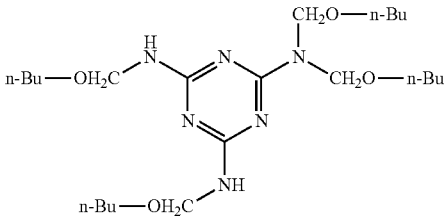

(B)-6

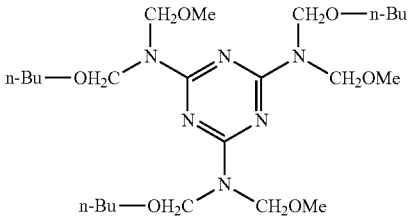

(B)-7

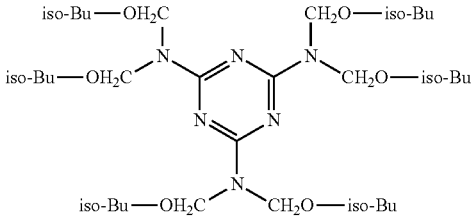

Examples of the commercially available product of the compound represented by Formula (B) include SUPER-MELAMI No. 90 (manufactured by NOF Corporation), SUPER BECKAMINE® TD-139-60 (manufactured by DIC Corporation), U-VAN 2020 (manufactured by Mitsui Chemicals, Inc.), SUMITEX RESIN M-3 (manufactured by Sumitomo Chemical Co., Ltd.), and NIKALAC MW-30 (manufactured by Nippon Carbide Industries Co., Inc.)

In addition, the compound represented by Formula (B) (including oligomers) may be dissolved in an appropriate solvent such as toluene, xylene or ethyl acetate, and washed with distilled water, ion exchanged water or the like, or may be treated with an ion exchange resin, in order to remove the effect of a residual catalyst after synthesizing or purchasing the commercially available product.

Next, the charge-transporting material will be described.

Preferable examples of the charge-transporting material include materials having at least one substituent (hereinafter, may be simply referred to as "specific reactive functional group") selected from —OH, —$OCH_3$, —$NH_2$, —SH, and —COOH. Particularly, as for the charge-transporting material, the number of the above specific reactive functional groups is preferably at least two, and more preferably three or more.

The charge-transporting material is preferably a compound represented by the following Formula (I):

$$F—((—R^{41}—X^2)_{n4}(R^{42})_{n6}—Y^2)_{n5} \quad (I)$$

In Formula (I), F represents an organic group derived from a compound having a hole transport ability, $R^{41}$ and $R^{42}$ each independently represent a linear or branched alkylene group having from 1 to 5 carbon atoms, n4 represents 0 or 1, n5 represents an integer of from 1 to 4, and n6 represents 0 or 1. $X^2$ represents an oxygen atom, NH, or a sulfur atom, and $Y^2$ represents —OH, —$OCH_3$, —NH—, —SH, or —COOH (that is, the above specific reactive functional group).

In Formula (I), in the organic group derived from a compound having a hole transport ability that is represented by F, as the compound having a hole transport ability, arylamine derivatives are preferably used. As the arylamine derivative, a triphenylamine derivative and a tetraphenylbenzidine derivative are preferably used.

In addition, the compound represented by Formula (I) is preferably a compound represented by the following Formula (II).

(II)

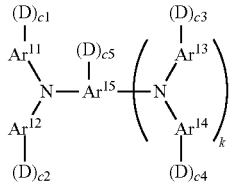

In Formula (II), $Ar^{11}$ to $Ar^{14}$ may be the same as or different from each other, and each independently represent a substituted or unsubstituted aryl group, $Ar^{15}$ represents a substituted or unsubstituted aryl group, or a substituted or unsubstituted arylene group, D represents —(—$R^{41}$—$X^2$)$_{n4}$($R^{42}$)$_{n6}$—$Y^2$, c1 to c5 independently represent 0 or 1, k represents 0 or 1, and the total number of D is from 1 to 4. In addition, $R^{41}$ and $R^{42}$ each independently represent a linear or branched alkylene group having from 1 to 5 carbon atoms, n4 represents 0 or 1, n6 represents 0 or 1, $X^2$ represents an oxygen atom, NH, or a sulfur atom, and $Y^2$ represents —OH, —OCH, —$NH_2$, —SH, or —COOH.

In Formula (II), "—(—$R^{41}$—$X^2$)$_{n4}$($R^{42}$)$_{n6}$—$Y^2$" represented by D is the same as in Formula (I), and $R^{41}$ and $R^{42}$ each independently represent a linear or branched alkylene group having from 1 to 5 carbon atoms. In addition, n4 is preferably 1. In addition, $X^2$ is preferably an oxygen atom. In addition, $Y^2$ is preferably a hydroxyl group.

The total number of D in Formula (II) corresponds to n5 in Formula (I), and is preferably from 2 to 4, and more preferably from 3 to 4. That is, in Formula (I) and Formula (II), the number of the above specific reactive functional groups is preferably from 2 to 4, and more preferably from 3 to 4 in one molecule.

In Formula (II), each of $Ar^{11}$ to $Ar^{14}$ is preferably one of compounds represented by the following Formulae (1) to (7). In the following Formulae (1) to (7), "-$(D)_{c1}$" to "-$(D)_{c4}$" that may be connected to $Ar^{11}$ to $Ar^{14}$, respectively, are represented by "-$(D)_c$".

(1)

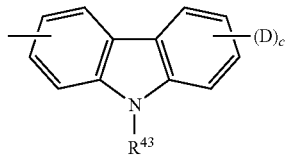

(2)

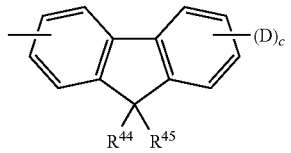

-continued (3)

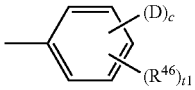

(4)

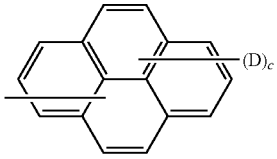

(5)

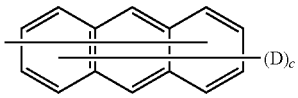

(6)

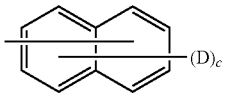

(7)

$$—Ar^{21}—(Z^1)_{s1}—Ar^{22}—(D)_c$$

In Formulae (1) to (7), $R^{43}$ represents one type selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms, $R^{44}$ and $R^{45}$ each represent one type selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, $R^{46}$ represents one type selected from the group consisting of an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, $Ar^{21}$ and $Ar^{22}$ represent a substituted or unsubstituted arylene group, D and c are the same as "D" and "c1 to c4" in Formula (II), respectively, s1 represents 0 or 1, and t1 represents an integer of from 1 to 3.

Here, $Ar^{21}$ and $Ar^{22}$ in Formula (7) are preferably represented by the following Formula (8) or (9).

(8)

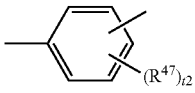

(9)

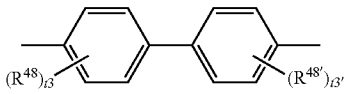

In Formulae (8) and (9), $R^{47}$, $R^{48}$, and $R^{48'}$ each represent one type selected from the group consisting of an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, and t2, t3, and t3' each represent an integer of from 1 to 3.

In addition, $Z^1$ in Formula (7) is preferably represented by any one of the following Formulae (10) to (17).

(10)

$$—(CH_2)_{q1}—$$

(11)

$$—(CH_2CH_2O)_{r1}—$$

(12)

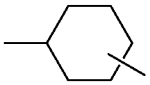

(13)

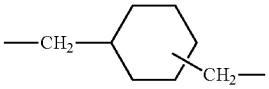

(14)

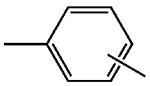

(15)

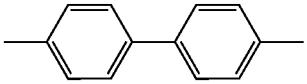

(16)

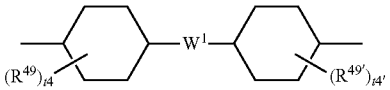

(17)

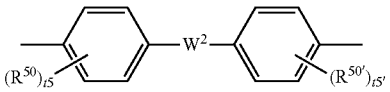

In Formulae (10) to (17), $R^{45}$, $R^{49'}$, $R^{50}$, and $R^{50'}$ each represent one type selected from the group consisting of an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, an aralkyl group having from 7 to 10 carbon atoms, and a halogen atom, $W^1$ and $W^2$ each represent a divalent group, q1 and r1 each represent an integer of from 1 to 10, and t4, t4', t5, and t5' each represent an integer of from 1 to 3.

Each of $W^1$ and $W^2$ in the above Formulae (16) and (17) is preferably any one of divalent groups represented by the following Formulae (18) to (26). However, in Formula (25), u1 represents an integer of from 0 to 3.

(18)

$$—CH_2—$$

(19)

$$—C(CH_3)_2—$$

(20)

$$—O—$$

(21)

$$—S—$$

(22)

$$—C(CF_3)_2—$$

(23)

$$—Si(CH_3)_2—$$

(24)

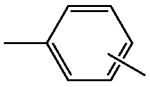

-continued (25)

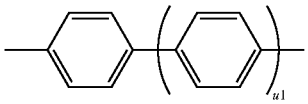

(26)

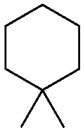

In addition, in Formula (II), $Ar^{15}$ is an aryl group represented by any one of the aryl groups (1) to (7) exemplified in the description of $Ar^{11}$ to $Ar^{14}$ when k is 0. When k is 1, $Ar^{15}$ is preferably an arylene group obtained by removing a hydrogen atom from one of the aryl groups (1) to (7).

Specific examples of the compound represented by Formula (I) include the following compounds (I-1) to (I-31). The compound represented by the above Formula (I) is not limited thereto.

I-1

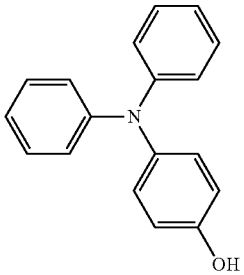

I-2

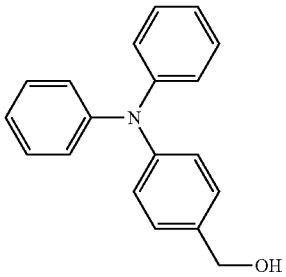

I-3

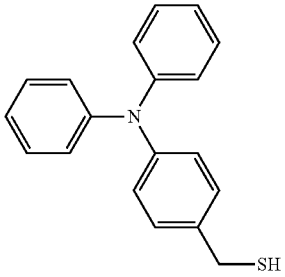

-continued

I-4

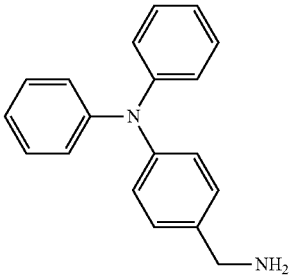

I-5

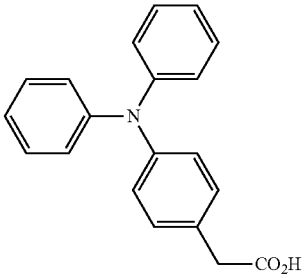

I-6

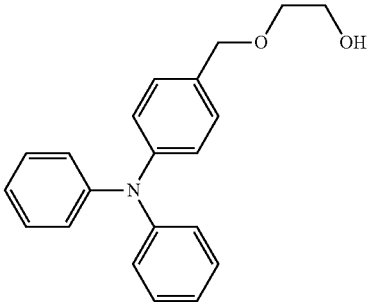

I-7

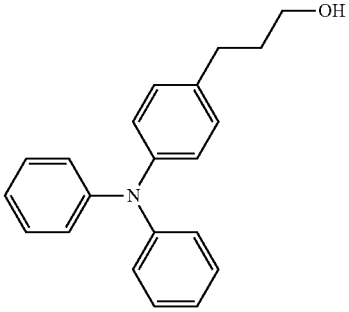

I-8

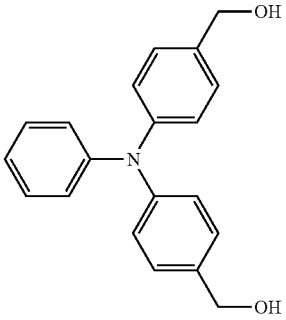

-continued
I-9
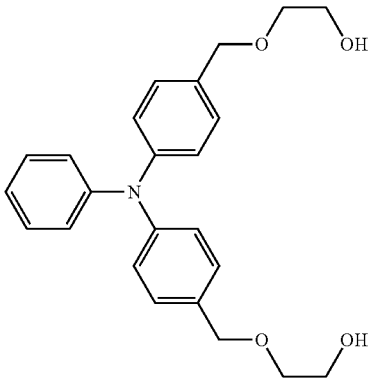
I-10
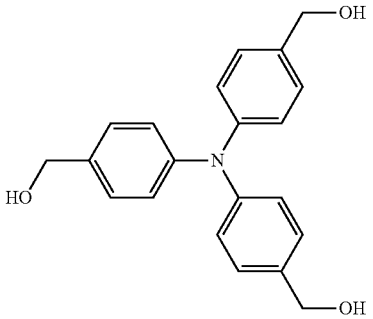
I-11
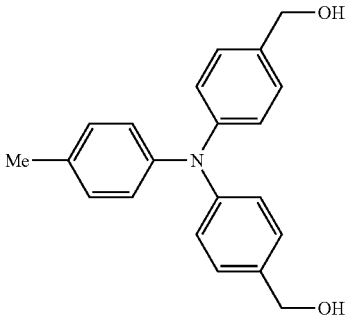
I-12
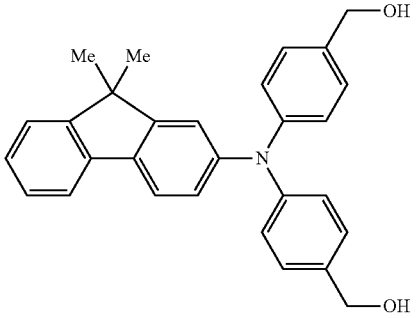
-continued
I-13
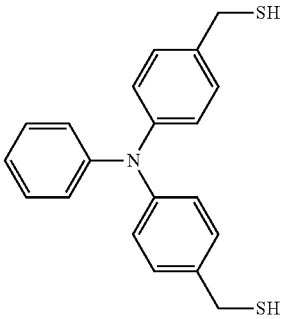
I-14
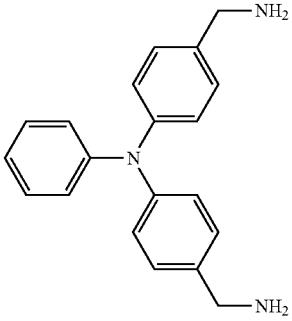
I-15
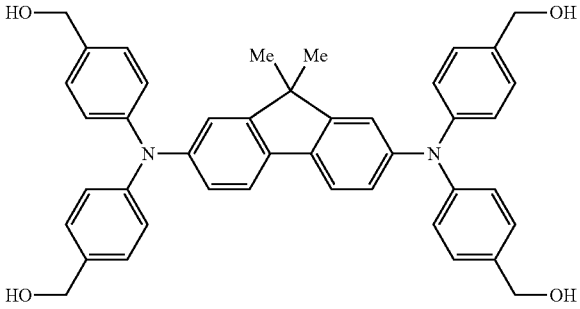
I-16
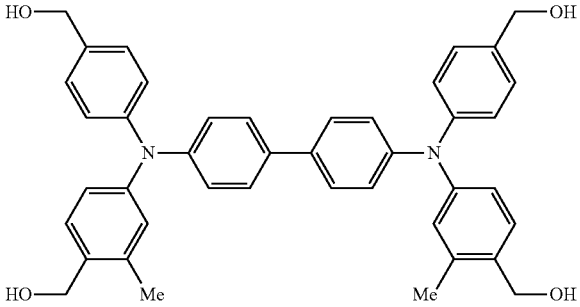
I-17
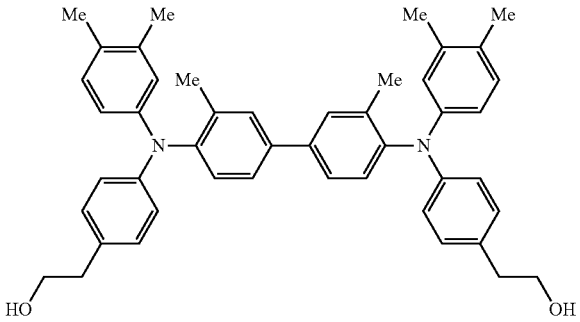

-continued
I-18
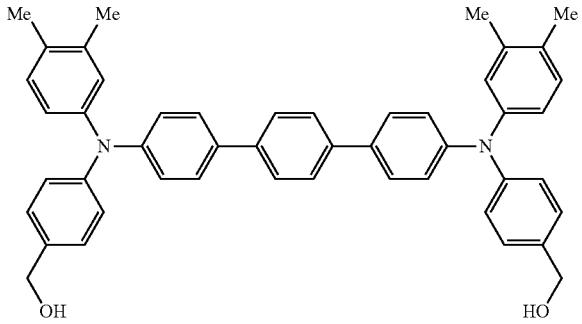
I-19
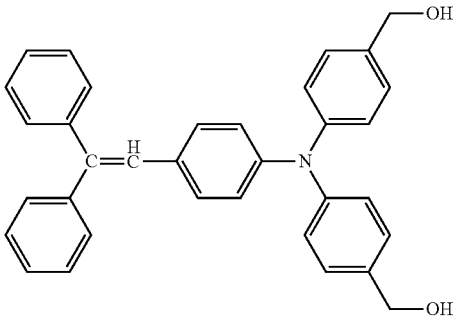
I-20
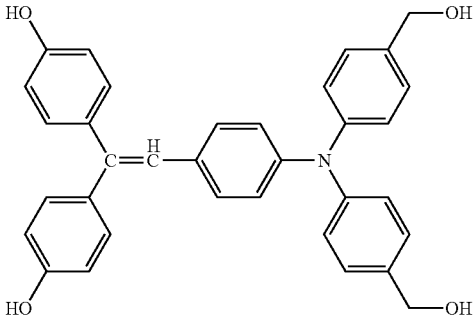
I-21
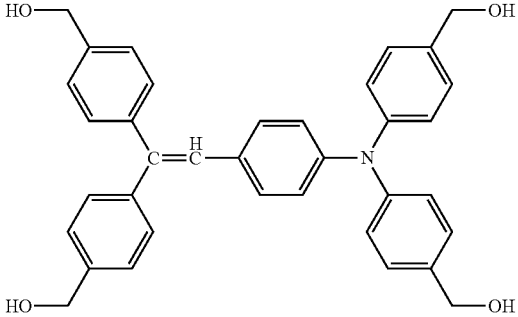
-continued
I-22
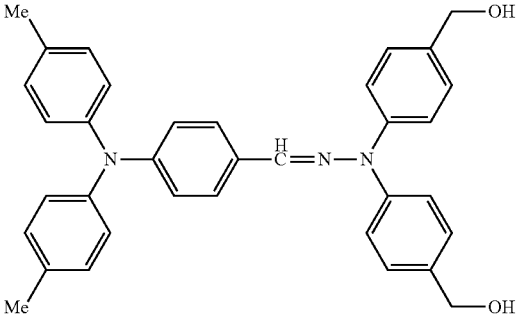
I-23
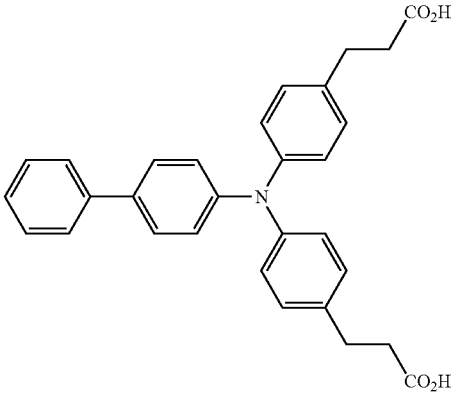
I-24
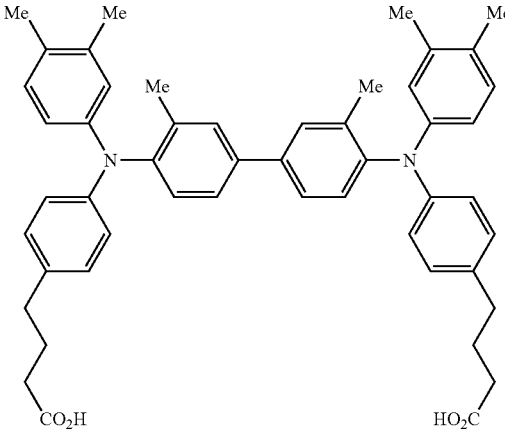
I-25
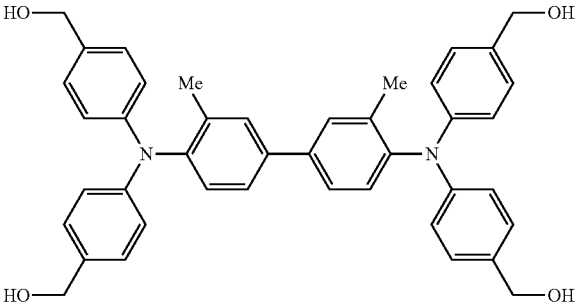

-continued

I-26

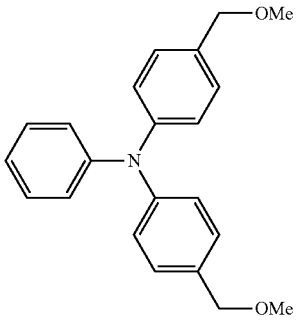

I-27

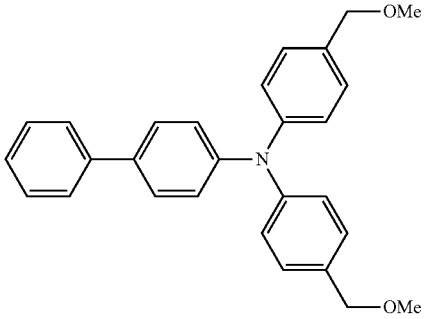

I-28

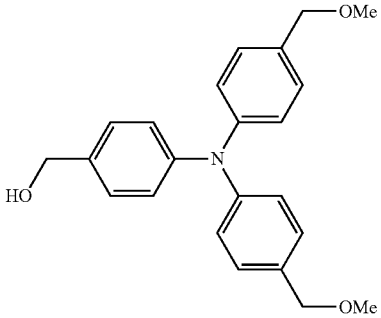

I-29

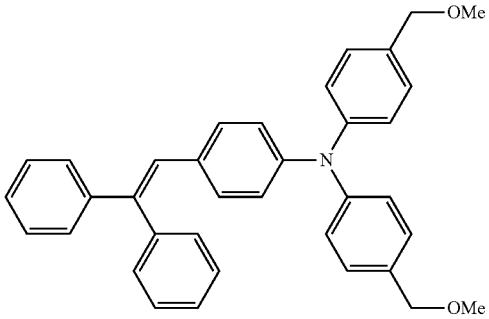

I-30

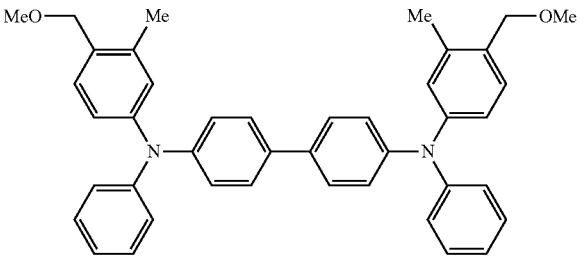

-continued

I-31

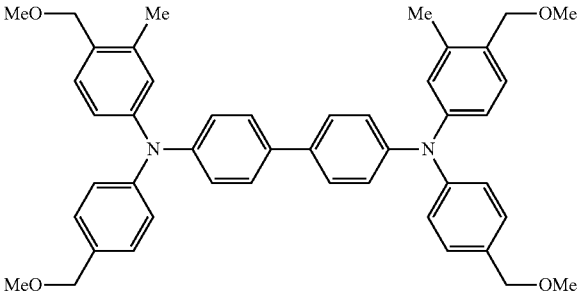

Other Compositions

In the protective layer 5, a thermosetting resin such as a phenol resin, a melamine resin, a urea resin, an alkyd resin, and a benzoguanamine resin may be used. In addition, a compound having more functional groups in one molecule, such as spiroacetal guanamine resins (for example, "CTU-GUANAMINE", manufactured by Ajinomoto Fine-Techno Co., Inc.), may be copolymerized with the materials of the cross-linked substance.

In addition, the protective layer 5 may include a surfactant added to. Preferable examples of the surfactant to be used include surfactants including at least one structure of a fluorine atom, an alkylene oxide structure, and a silicone structure.

The protective layer 5 may include an antioxidant added thereto. Preferable examples of the antioxidant include hindered phenol antioxidants and hindered amine antioxidants, and known antioxidants such as organic sulfur antioxidants, phosphite antioxidants, dithiocarbamate antioxidants, thiourea antioxidants, and benzimidazole antioxidants may be used. The amount of the antioxidant added is preferably 20% by weight or less, and more preferably 10% by weight or less.

Examples of the hindered phenol antioxidant include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hydroxy-benzyl phosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-1-methylbenzyl-4-methylphenyl acrylate, and 4,4'-butylidenebis(3-methyl-6-t-butylphenol).

The protective layer 5 may contain a curing catalyst for promoting curing of the guanamine compound and the melamine compound or the charge transport material. As the curing catalyst, an acid catalyst is preferably used. Although aliphatic carboxylic acids such as acetic acid, chloroacetic acid, trichloroacetic acid, trifluoroacetic acid, oxalic acid, maleic acid, malonic acid, and lactic acid, aromatic carboxylic acids such as benzoic acid, phthalic acid, terephthalic acid, and trimellitic acid, and aliphatic and aromatic sulfonic acids such as methanesulfonic acid, dodecylsulfonic acid, benzenesulfonic acid, dodecylbenzenesulfonic acid, and naphthalenesulfonic acid are used as the acid catalyst, a sulfur-containing material is preferably used.

The sulfur-containing material as the curing catalyst preferably has an acidic property at room temperature (for example, 25° C.) or after heating, and at least one kind of organic sulfonic acids and derivatives thereof is most preferable. The presence of these catalysts in the protective layer 5 is easily confirmed through energy dispersive X-ray spectroscopy (EDS), X-ray photoelectron spectroscopy (XPS), or the like.

Examples of the organic sulfonic acid and/or a derivative thereof include paratoluenesulfonic acid, dinonylnaphthalene sulfonic acid (DNNSA), dinonylnaphthalenedisulfonic acid (DNNDSA), dodecylbenzenesulfonic acid, and phenol sulfonic acid. Among them, paratoluenesulfonic acid and dodecylbenzenesulfonic acid are preferable. In addition, salts of organic sulfonates may also be used as long as they are capable of being dissociated in a curable resin composition.

In addition, a so-called heat latent catalyst, that exhibits an increased catalytic activity when heat is applied thereto, may be used.

Examples of the heat latent catalyst include microcapsules in which an organic sulfone compound or the like is coated with a polymer in the form of particles, porous compounds such as zeolite onto which an acid is adsorbed, heat latent protonic acid catalysts in which a protonic acid and/or a derivative thereof are blocked with a base, protonic acids and/or derivatives thereof esterified by primary or secondary alcohol, protonic acids and/or derivatives thereof blocked with vinyl ethers and/or vinyl thioethers, monoethyl amine complexes of boron trifluoride, and pyridine complexes of boron trifluoride.

Among them, those in which a protonic acid and/or a derivative thereof is blocked with a base are preferable.

Examples of the protonic acid of the heat latent protonic acid catalyst include sulfuric acid, hydrochloric acid, acetic acid, formic acid, nitric acid, phosphoric acid, sulfonic acid, monocarboxylic acid, polycarboxylic acid, propionic acid, oxalic acid, benzoic acid, acrylic acid, methacrylic acid, itaconic acid, phthalic acid, maleic acid, benzene sulfonic acid, o-toluenesulfonic acid, m-toluenesulfonic acid, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. Examples of the protonic acid derivative include neutralized alkali metal salts and neutralized alkaline earth metal salts of protonic acids such as sulfonic acid and phosphoric acid, and polymer compounds in which a protonic acid skeleton is incorporated into a polymer chain (polyvinylsulfonic acids and the like). Examples of the base to block the protonic acid include amines.

The amines are classified into primary, secondary, and tertiary amines. Any of the amines may be used without particular limitation.

Examples of the primary amines include methylamine, ethylamine, propylamine, isopropylamine, n-butylamine, isobutylamine, t-butylamine, hexylamine, 2-ethylhexylamine, secondary butylamine, allylamine, and methylhexylamine.

Examples of the secondary amines include dimethylamine, diethylamine, di-n-propylamine, diisopropylamine, di-n-butylamine, diisobutyl amine, di-t-butylamine, dihexylamine, di(2-ethylhexyl)amine, N-isopropyl-N-isobutylamine, di(2-ethylhexyl)amine, di-secondary-butylamine, diallylamine, N-methylhexylamine, 3-pipecoline, 4-pipecoline, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazin, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethyl hexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Examples of the commercially available product include "NACUPE 2501" (toluenesulfonic acid dissociation, methano/isopropanol solvent, pH of 6.0 to 7.2, dissociation temperature of 80° C.), "NACURE 2107" (p-toluenesulfonic acid dissociation, isopropanol solvent, pH of 8.0 to 9.0, dissociation temperature of 90° C.), "NACURE 2500" (p-toluenesulfonic acid dissociation, isopropanol solvent, pH of 6.0 to 7.0, dissociation temperature of 65° C.), "NACURE 2530" (p-toluenesulfonic acid dissociation, methanol/isopropanol solvent, pH of 5.7 to 6.5, dissociation temperature of 65° C.), "NACURE 2547" (p-toluenesulfonic acid dissociation, aqueous solution, pH of 8.0 to 9.0, dissociation temperature of 107° C.), "NACORE 2558" (p-toluene sulfonic acid dissociation, ethylene glycol solvent, pH of 3.5 to 4.5, dissociation temperature of 80° C.), "NACURE XP-357" (p-toluenesulfonic acid dissociation, methanol solvent, pH of 2.0 to 4.0, dissociation temperature of 65° C.) "NACURE XP-386" (p-toluenesulfonic acid dissociation, aqueous solution, pH of 6.1 to 6.4, dissociation temperature of 80° C.), "NACURE XC-2211" (p-toluenesulfonic acid dissociation, pH of 7.2 to 8.5, dissociation temperature of 80° C.), "NACURE 5225" (dodecylbenzenesulfonic acid dissociation, isopropanol solvent, pH of 6.0 to 7.0, dissociation temperature of 120° C.), "NACURE 5414" (dodecylbenzenesulfonic acid dissociation, xylene solvent, dissociation temperature of 120° C.), "NACURE 5528" (dodecylbenzenesulfonic acid dissociation, isopropanol solvent, pH of 7.0 to 8.0, dissociation temperature of 120° C.), "NACURE 5925" (dodecylbenzenesulfonic acid dissociation, pH of 7.0 to 7.5, dissociation temperature of 130° C.), "NACURE 1323" (dinonyl naphthalene sulfonic acid dissociation, xylene solvent, pH of 6.8 to 7.5, dissociation temperature of 150° C.), "NACURE 1419" (dinonylnaphthalenesulfonic acid dissociation, xylene/methyl isobutyl ketone solvent, dissociation temperature of 150° C.), "NACURE 1557" (dinonylnaphthalenesulfonic acid dissociation, butanol/2-butoxyethanol solvent, pH of 6.5 to 7.5, dissociation temperature of 50° C.), "NACURE X49-110" (dinonylnaphthalene disulfonic acid dissociation, isobutanol/isopropanol solvent, pH of 6.5 to 7.5, dissociation temperature of 90° C.), "NACURE 3525" (dinonylnaphthalene disulfonic acid dissociation, isobutanol/isopropanol solvent, pH of 7.0 to 8.5, dissociation temperature of 120° C.), "NACURE XP-383" (dinonylnaphthalene disulfonic acid dissociation, xylene solvent, dissociation temperature of 120° C.), "NACURE 3327" (dinonylnaphthalene disulfonic acid dissociation, isobutanol/isopropanol solvent, pH of 6.5 to 7.5, dissociation temperature of 150° C.), "NACURE 4167" (phosphoric acid dissociation, isopropanol/isobutanol solvent, pH of 6.8 to 7.3, dissociation temperature of 80° C.), "NACURE XP-297" (phosphoric acid dissociation, water/isopropanol solvent, pH of 6.5 to 7.5, dissociation temperature of 90° C.), and "NACURE 4575" (phosphoric acid dissociation, pH of 7.0 to 8.0, dissociation temperature of 110° C.) (all manufactured by King Industries, Inc.).

These heat latent catalysts are used singly or in combination with two or more types.

Here, the blending amount of the catalyst is preferably from 0.1% by weight to 10% by weight, and particularly preferably from 0.1% by weight to 5% by weight with respect to the total solid content in the coating liquid, excluding the fluorine resin particles and the fluorinated alkyl group-containing copolymer.

Method of Forming Protective Layer

Here, as a method of manufacturing the photoreceptor according to this exemplary embodiment, as described above, a manufacturing method including a coating liquid preparation process of preparing a coating liquid for surface protective layer formation, a coating process of forming a coating film, and a drying process of forming a surface protective layer by drying the coating film is preferably applied.

In the coating liquid for protective layer formation, one type of solvent may be used or two or more types of solvents may be used in mixture. Preferable examples of the solvent for use in the formation of the protective layer 5 include cyclicaliphatic ketone compounds such as cyclobutanone, cyclopentanone, cyclohexanone, and cycloheptanone. In addition, other than the aliphatic ketone compounds, examples of the solvent include cyclic or linear alcohols such as methanol, ethanol, propanol, butanol, and cyclopentanol; linear ketones such as acetone and methyl ethyl ketone; cyclic or linear ethers such as tetrahydrofuran, dioxane, ethylene glycol, and diethyl ether; and halogenated aliphatic hydrocarbon solvents such as methylene chloride, chloroform, and ethylene chloride.

The amount of the solvent is not particularly limited, but it is preferably from 0.5 part by weight to 30 parts by weight, and more preferably from 1 part by weight to 20 parts by weight with respect to 1 part by weight of the guanamine compound and the melamine compound.

After coating, the resultant coating film is cured (or cross-linked) by heating at a temperature of, for example, 100° C. to 170° C., whereby the protective layer 5 is obtained.

Process Cartridge and Image Forming Apparatus

Next, a process cartridge and an image forming apparatus using the electrophotographic photoreceptor according to the exemplary embodiment will be described.

The process cartridge according to the exemplary embodiment is not particularly limited as long as it uses the electrophotographic photoreceptor according to the exemplary embodiment. Specifically, it is preferable that the process cartridge according to the exemplary embodiment be detachable from an image forming apparatus that transfers a toner image, which is obtained by developing an electrostatic latent image on a surface of a latent image holding member, onto a recording medium and forms an image on the recording medium; and include the electrophotographic photoreceptor according to the exemplary embodiment as the latent image holding member and at least one selected from a charging device, a developing device, and a cleaning device.

For example, the process cartridge according to the exemplary embodiment may include the electrophotographic photoreceptor according to the exemplary embodiment; and at least one unit selected from a charging unit that charges a surface of the electrophotographic photoreceptor; a latent image forming unit that forms an electrostatic latent image on a charged surface of the electrophotographic photoreceptor; a developing unit that develops the electrostatic latent image formed on the surface of the electrophotographic photoreceptor by using a toner to form a toner image; a transfer unit that transfers the toner image, which is formed on the surface of the electrophotographic photoreceptor, onto a recording medium; and a cleaning unit that cleans the electrophotographic photoreceptor.

In addition, the image forming apparatus according to the exemplary embodiment is not particularly limited as long as it uses the electrophotographic photoreceptor according to the exemplary embodiment. Specifically, it is preferable that the image forming apparatus according to the exemplary embodiment include the electrophotographic photoreceptor according to the exemplary embodiment; a charging unit that charges a surface of the electrophotographic photoreceptor; a latent image forming unit that forms an electrostatic latent image on a charged surface of the electrophotographic photoreceptor; a developing unit that develops the electrostatic latent image formed on the surface of the electrophotographic photoreceptor by using a toner to form a toner image; and a transfer device that transfers the toner image, which is formed on the surface of the electrophotographic photoreceptor, onto a recording medium. The image forming apparatus according to the exemplary embodiment may be a so-called tandem apparatus which includes plural photoreceptors corresponding to the toner of respective colors. In this case, it is preferable that all the photoreceptors be the electrophotographic photoreceptor according to the exemplary embodiment. In addition, the toner image may be transferred according to an intermediate transfer method using an intermediate transfer member.

FIG. 3 is a diagram schematically illustrating an image forming apparatus according to the exemplary embodiment. As illustrated in FIG. 3, an image forming apparatus 100 includes a process cartridge 300 including an electrophotographic photoreceptor 7, an exposure device 9, a transfer device 40 and an intermediate transfer member 50. In the image forming apparatus 100, the exposure device 9 is disposed at a position that may expose the electrophotographic photoreceptor 7 to light through an opening of the process cartridge 300; the transfer device 40 is disposed at a position facing the electrophotographic photoreceptor 7 with the intermediate transfer member 50 interposed therebetween; and the intermediate transfer medium 50 is disposed such that a part thereof is in contact with the electrophotographic photoreceptor 7.

In FIG. 3, the process cartridge 300 integrally supports the electrophotographic photoreceptor 7, a charging device 8, a developing device 11, and a cleaning device 13 in a housing. The cleaning device 13 has a cleaning blade (cleaning member). The cleaning blade 131 is disposed in contact with the surface of the electrophotographic photoreceptor 7.

In addition, an example of using a fibrous member 132 (roll-shape member) that supplies a lubricant 14 to the surface of the photoreceptor 7 and a fibrous member 133 (flat-brush-shape member) that assists cleaning is illustrated in the drawing, but these members may not be used.

As the charging device 8, a contact charger using, for example, a conductive or semi-conductive charging roller, charging brush, charging film, charging rubber blade, or charging tube is used. In addition, a non-contact roller charger, a well-known charger such as a scorotron charger or a corotron charger using corona discharge, or the like may also be used.

In addition, although not illustrated in the drawing, a photoreceptor heating member for raising the temperature of the electrophotographic photoreceptor 7 to reduce a relative temperature may be provided in the vicinity of the electrophotographic photoreceptor 7.

As the exposure device 9, for example, an optical device or the like, which exposes the surface of the electrophotographic photoreceptor 7 to light such as semiconductor laser light, LED light, or liquid crystal shutter light according to a predetermined image form, is used. The wavelength of a light source may be set in the spectral sensitivity range of a photoreceptor. The wavelength of a semiconductor laser light is mainly set in the near-infrared range having an oscillation wavelength of 780 nm. However, the wavelength is not limited thereto, and a laser having an oscillation wavelength of about 600 nm or a laser having an oscillation wavelength of 400 nm to 450 nm as a blue-light laser may also be used. In addition, a surface-emitting laser light source, which may emit multiple beams, may also be effectively used for color image formation.

As the developing device 11, a general developing device, which performs developing with or without the contact of a magnetic or non-magnetic single-component developer or a two-component developer, may be used. The developing device is not particularly limited as long as it has the above-described function and may be selected according to the purpose. For example, a well-known developing unit, which has a function of attaching a single-component developer or a two-component developer to the electrophotographic photoreceptor 7 using a brush, a roller, or the like, may be used. Among these, it is preferable that a developing roller of which the surface holds a developer be used.

Hereinafter, a toner for use in the developing device 11 will be described.

The average shape factor ($(ML^2/A)\times(\pi/4)\times100$, where ML represents a maximum length of the particle and A represents a projected area of the particle) of the toner for use in the image forming apparatus of this exemplary embodiment is preferably from 100 to 150, more preferably from 105 to 145, and even more preferably from 11 to 140. Furthermore, a volume average particle diameter of the toner is preferably from 3 μm to 12 μm, and more preferably from 3.5 μm to 9 μm.

Although the toner is not particularly limited by a manufacturing method, a toner is used that is manufactured by, for example, a kneading and pulverizing method in which a binder resin, a colorant, a release agent, and optionally, a charge-controlling agent and the like are added, and the resultant mixture is kneaded, pulverized and classified; a method in which the shapes of the particles obtained using the kneading and pulverizing method are changed by a mechanical impact force or thermal energy; an emulsion polymerization and aggregation method in which polymerizable monomers of a binder resin are subjected to emulsion polymerization, the resultant dispersion formed and a dispersion of a colorant, a release agent, and optionally, a charge-controlling agent and the like are mixed, aggregated, and heat-melted to obtain toner particles; a suspension polymerization method in which polymerizable monomers for obtaining a binder resin, a colorant, a release agent, and optionally, a solution such as a charge-controlling agent are suspended in an aqueous solvent and polymerization is performed; or a dissolution suspension method in which a binder resin, a colorant, a release agent, and optionally, a solution such as a charge-controlling agent are suspended in an aqueous solvent and granulation is performed.

In addition, a known method such as a manufacturing method in which the toner obtained using one of the above methods is used as a core to achieve a core shell structure by further making aggregated particles adhere to the toner and by coalescing them with heating is used. As the toner manufacturing method, a suspension polymerization method, an emulsion polymerization and aggregation method, and a dissolution suspension method, all of which are used to manufacture the toner using an aqueous solvent, are preferable, and an emulsion polymerization and aggregation method is particularly preferable from the viewpoint of controlling the shape and the particle size distribution.

The toner particles preferably contain a binder resin, a colorant, and a release agent, and it may further contain silica or a charge-controlling agent.

Examples of the binder resin for use in the toner particles include homopolymers and copolymers of styrenes such as styrene and chlorostyrene, monoolefins such as ethylene, propylene, butylene, and isoprene, vinyl esters such as vinyl acetate, vinyl propionate, vinyl benzoate, and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone, and polyester resins formed by copolymerization of dicarboxylic acids and diols.

Particularly representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and a polyester resin. Further examples of the binder resin include polyurethane, an epoxy resin, a silicone resin, polyamide, modified rosin, and paraffin wax.

Representative examples of the colorant include magnetic powders such as magnetite and ferrite, carbon black, aniline blue, calcoil blue, chrome yellow, ultramarine blue, Du Pont oil red, quinoline yellow, methylene blue chloride, phthalocyanine blue, malachite green oxalate, lamp black, Rose Bengal, C. I. Pigment Red 48:1, C. I. Pigment Red 122, C. I. Pigment Red 57:1, C. I. Pigment Yellow 97, C.I. Pigment Yellow 17, C. I. Pigment Blue 15:1, and C. I. Pigment Blue 15:3.

Representative examples of the release agent include low-molecular-weight polyethylene, low-molecular-weight polypropylene, Fischer-Tropsch wax, montan wax, carnauba wax, rice wax, and candelilla wax.

In addition, as the charge-controlling agent, a known charge-controlling agent is used, but specifically, an azo metal complex compound, a metal complex compound of salicylic acid, or a polar group-containing resin-type charge-controlling agent is used. When the toner is manufactured by a wet manufacturing method, a material which has poor water solubility is preferably used. In addition, the toner may be either a magnetic toner containing a magnetic material or a nonmagnetic toner containing no magnetic material.

The toner for use in the developing device 11 is manufactured by mixing the toner particles with the external additives with a Henschel mixer or a V-blender. Moreover, when the toner particles are manufactured by a wet process, the additives may be externally added as well by a wet process.

Lubricating particles may be added to the toner for use in the developing device 11. Examples of the lubricating particles include solid lubricants such as graphite, molybdenum disulfide, talc, fatty acids, and fatty acid metallic salts, low-molecular-weight polyolefins such as polypropylene, polyethylene, and polybutene, silicones that are softened by heating, aliphatic amids such as oleamide, erucamide, ricinoleic acid amide, and stearamide, vegetable waxes such as carnauba wax, rice wax, candelilla wax, Japan wax, and jojoba oil, animal waxes such as beeswax, mineral and petroleum waxes such as montan wax, ozocerite, ceresine, paraffin wax, microcrystalline wax, and Fischer-Tropsch wax, and modified products thereof. These lubricating particles may be used singly or in combination with two or more types. The average particle diameter thereof is preferably from 0.1 μm to 10 μm. The particle diameter may be equalized by pulverizing the products having the above-described chemical structure. The amount of the particles added to the toner is preferably from 0.05% by weight to 2.0% by weight, and more preferably from 0.1% by weight to 1.5% by weight.

Inorganic particles, organic particles, composite particles formed by making inorganic particles adhere to organic particles, or the like may be added to the toner for use in the developing device 11.

Examples of the inorganic particles include various types of inorganic oxides, nitrides, and borides, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The inorganic particles may be treated with a titanium coupling agent such as tetrabutyl titanate, tetraoctyl titanate, isopropyltriisostearoyl titanate, isopropyltridecylbenzenesulfonyl titanate, or bis(dioctylpyrophosphate)oxyacetate titanate, or a silane coupling agent such as γ-(2-aminoethyl) aminopropyltrimethoxysilane, γ-(2-aminoethyl)aminopropylmethyldimethoxysilane, γ-methacryloxypropyltrimethoxysilane, N-β-(N-vinylbenzylaminoethyl)-γaminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane. In addition, inorganic particles subjected to a hydrophobization treatment with higher fatty acid metallic salt such as silicone oil, aluminum stearate, zinc stearate, or calcium stearate are also preferably used.

Examples of the organic particles include styrene resin particles, styrene-acrylic resin particles, polyester resin particles, and urethane resin particles.

As for the particle diameter, the number average particle diameter is preferably from 5 nm to 1,000 nm, more preferably from 5 nm to 800 nm, and even more preferably from 5 nm to 700 nm. Furthermore, the sum of the amount of the above-described particles added and the amount of the lubricating particles added is preferably 0.6% by weight or greater.

As other inorganic oxides added to the toner, it is preferable to use small-diameter inorganic oxides having a primary particle diameter of 40 nm or less, and further to add larger-diameter inorganic oxides. As the inorganic oxide particles, known inorganic oxide particles are used, but silica and titanium oxide are preferably used in combination.

In addition, small-diameter inorganic particles may be subjected to a surface treatment. Furthermore, carbonates such as calcium carbonate and magnesium carbonate and inorganic minerals such as hydrotalcite are also preferably added.

In addition, an electrophotographic color toner is used in mixture with a carrier. Examples of the carrier include an iron powder, glass beads, a ferrite powder, a nickel powder, and powders obtained by coating the surfaces of the above powders with a resin. The mixing ratio between the toner and the carrier is set in accordance with the need.

Examples of the transfer device 40 include known transfer charging units such as contact-type transfer charging units using a belt, a roller, a film, a rubber blade, and the like, scorotron transfer charging units using corona discharge, and corotron transfer charging units.

As the intermediate transfer member 50, a belt-shaped intermediate transfer member (intermediate transfer belt) of semiconductivity-imparted polyimide, polyamide-imide, polycarbonate, polyarylate, polyester, rubber, or the like is used. In addition, examples of the shape of the intermediate transfer member 50 include a drum shape other than the belt shape.

In addition to the above-described devices, the image forming apparatus 100 may be further provided with, for example, an erasing device that subjects the photoreceptor 7 to optical erasing.

Figure 5:
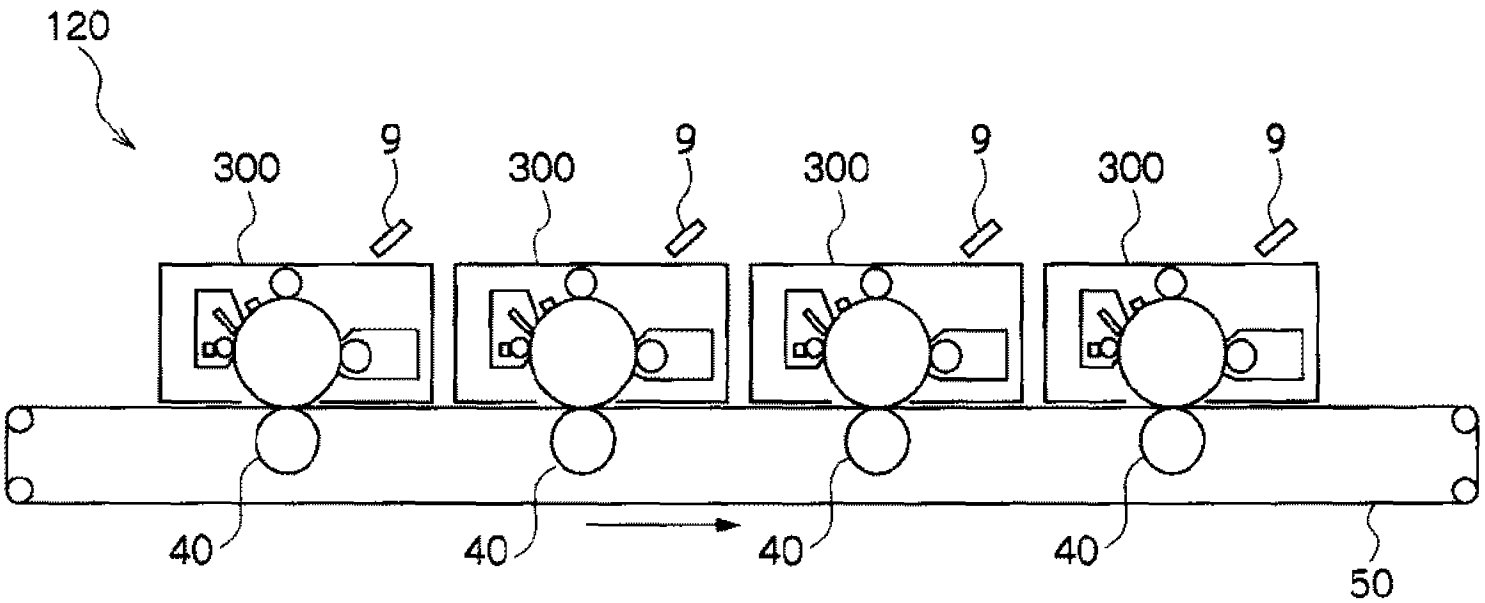
FIG. 5 is a diagram schematically illustrating the configuration of an image forming apparatus according to another exemplary embodiment.

FIG. 5 is a cross-sectional view schematically illustrating an image forming apparatus according to another exemplary embodiment. As shown in FIG. 5, the image forming apparatus 120 is a tandem-type multicolor image forming apparatus having four process cartridges 300 mounted thereon. In the image forming apparatus 120, the four process cartridges 300 are disposed in parallel to each other on an intermediate transfer member 50, and one electrophotographic photoreceptor is used for one color. The forming apparatus 120 has the same configuration as that of the image forming apparatus 100, except for being a tandem type.

In the image forming apparatus (process cartridge) according to this exemplary embodiment, the developing device may have a developing roller as a developer holding member that is moved (rotated) in a direction reverse to the moving direction (rotation direction) of the electrophotographic photoreceptor. Here, the developing roller has a cylindrical developing sleeve that holds a developer on the surface thereof, and the developing device may have a regulating member to regulate the amount of the developer to be supplied to the developing sleeve. By moving (rotating) the developing roller of the developing device in a direction reverse to the rotation direction of the electrophotographic photoreceptor, the surface of the electrophotographic photoreceptor is rubbed with the toner remaining between the developing roller and the electrophotographic photoreceptor.

Furthermore, in the image forming apparatus of this exemplary embodiment, the gap between the developing sleeve and the photoreceptor is preferably from 200 μm to 600 μm, and more preferably from 300 μm to 500 μm. Furthermore, the gap between the developing sleeve and a regulating blade as the above-described regulating member that regulates the amount of the developer is preferably from 300 μm to 1,000 μm, and more preferably from 400 μm to 750 μm.

Furthermore, an absolute value of the traveling speed of a developing roll surface is preferably from 1.5 times to 2.5 times, and more preferably from 1.7 times to 2.0 times the absolute value (process speed) of the traveling speed of a photoreceptor surface.

In the image forming apparatus (process cartridge) according to this exemplary embodiment, it is preferable that the developing device (developing unit) be provided with a developer holding member having a magnetic substance, and develop an electrostatic latent image with a two-component developer containing a magnetic carrier and a toner.

EXAMPLES

Hereinafter, the invention will be described in more detail on the basis of Examples and Comparative Examples. However, the invention is not limited at all to the following Examples.

Example 1

Formation of Undercoat Layer 100 parts by weight of zinc oxide (average particle diameter: 70 nm, manufactured by Tayca Corporation, specific surface area value: 15 m/g) is mixed and stirred with 500 parts by weight of tetrahydrofuran, and 1.25 parts by weight of KBM603 (manufactured by Shin-Etsu Chemical Co., Ltd.) as a silane coupling agent is added thereto and stirred for 2 hours. Thereafter, the tetrahydrofuran is distilled away by distillation under reduced pressure and baking is performed at 120° C. or 3 hours to obtain zinc oxide particles surface-treated with the silane coupling agent.

38 parts by weight of a solution obtained by dissolving 60 parts by weight of the surface-treated zinc oxide particles, 0.6 part by weight of alizarin, 13.5 parts by weight of blocked isocyanate as a curing agent (SUMIDUR 3173, manufactured by Sumitomo Bayer Urethane Co., Ltd.), and 15 parts by weight of a butyral resin (S-LEC BM-1, manufactured by Sekisui Chemical Co., Ltd.) in 85 parts by weight of methyl ethyl ketone is mixed with 25 parts by weight of methyl ethyl ketone. The mixture is dispersed for 4 hours with a sand mill using glass beads having a diameter of 1 mm to obtain a dispersion.

To the obtained dispersion, 0.005 part by weight of dioctyltin dilaurate and 4.0 parts by weight of silicone resin particles (TOSPEARL 145, manufactured by GE-Toshiba Silicone Co., Ltd.) are added as catalysts, whereby a coating liquid for undercoat layer formation is obtained.

An aluminum substrate having a diameter of 30 mm is coated with the coating liquid by using a dipping coating method, and the coating liquid is cured by drying at 180° C. for 40 minutes, whereby an undercoat layer having a thickness of 25 μm is obtained.

Formation of Charge Generation Layer

Next, a mixture of 15 parts by weight of a chlorogallium phthalocyanine crystal as a charge generation material having strong diffraction peaks at least at Bragg angles (2θ+0.2°) of 7.4°, 16.6°, 25.5°, and 28.3° with respect to CuKα characteristic X-ray, 10 parts by weight of a vinyl chloride-vinyl acetate copolymeer resin (VMCH, manufactured by Nippon Union Carbide Corporation), and 300 parts by weight of n-butyl alcohol is dispersed for 4 hours with a sand mill using glass beads having a diameter of 1 mm to obtain a coating liquid for charge generation layer formation.

The undercoat layer is dipped in and coated with the coating liquid for charge generation layer formation, and dried for 5 minutes at 120° C. to form a charge generation layer having a thickness of 0.2 μm.

Formation of Charge Transport Layer

Next, 42 parts by weight of N,N'-bis(3-methylphenyl)-N,N'-diphenylbenzidine and 58 parts by weight of a bisphenol S polycarbonate resin (TS2050: viscosity average molecular weight: 50,000: manufactured by Teijin Chemicals Ltd.) are mixed with and dissolved in 280 parts by weight of tetrahydrofuran and 120 parts by weight of toluene to obtain a coating liquid for charge transport layer formation.

The aluminum substrate having the charge generation layer formed thereon is dipped in and coated with the coating liquid for charge transport layer formation, and dried for 40 minutes at 135° C. to form a charge transport layer having a thickness of 20 μm.

Formation of Protective Layer

Next, a mixture of 0.025 part by weight of a fluorine comb-type graft polymer (trade name: GF300, manufactured by Toagosei Co., Ltd.), 5 parts by weight of polytetrafluoroethylene particles (trade name: LUBRON L2, manufactured by Daikin Industries Ltd.), and 20 parts by weight of cyclopetanone is mixed with a liquid obtained by dissolving 100 parts by weight of a compound (acrylic resin) represented by the following Structural Formula (F) in 200 parts by weight of cyclopetanone, and is dispersed using a collision-type high-pressure disperser (trade name: Nanomizer, manufactured by Yoshida Kikai Co., Ltd.). Then, 0.01 part by weight of a thermal polymerization initiator (Otazo-15, manufactured by Otsuka Chemical Co., Ltd.) is added thereto to prepare a coating liquid for protective layer formation.

Structural Formula (F)

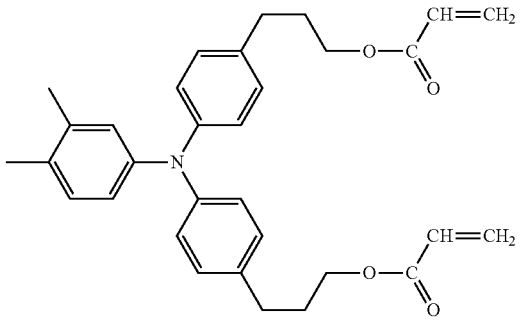

The aluminum substrate having the charge transport layer formed thereon is coated with the obtained coating liquid for protective layer formation by using a dipping method, and vacuum deaeration is performed. Then, drying is performed under conditions of 75° C. and 10 minutes in a first stage and 150° C. and 40 minutes in a second stage to form a protective layer having a thickness of 5 μm, whereby a photoreceptor 1 is prepared.

Measurement of (A)/(B) and (C)/(D)

As for the obtained photoreceptor, values of A, B, C, and D are calculated by image analysis using a photograph (surface: 60.38 μm×45.47 μm, inside of surface layer (cross-section): 81 μm×5 μm) obtained by observation using a laser microscope, and values of [(A)/(B)] and [(C)/(D)] are calculated.

In addition, the number (E21) of aggregated particles in which 21 or more fluorine resin particles are connected and aggregated on the surface of the protective layer, and the number (E6) of aggregated particles in which 6 or more fluorine resin particles are connected and aggregated on the cross-section of the protective layer in the depth direction are also calculated. The results are shown in Table 1.

Evaluation Test: Evaluation of Transfer Efficiency

In order to perform image quality evaluation using the obtained photoreceptor, the obtained photoreceptor 1 is mounted on DocuCentre C6550I (manufactured by Fuji Xerox Co., Ltd.), and an image forming test in which an image having an image density of 5% is formed on A4 paper is performed under conditions of 25° C. and 50%. At this time, the weight of the toner in the toner image formed on the surface of the photoreceptor 1 and the weight of the toner transferred onto the A4 paper from the surface of the photoreceptor 1 are measured, and the transfer efficiency is calculated using the following expression. The results are shown in Table 1.

(Weight of Toner Transferred onto A4 Paper from Surface of Photoreceptor 1/Weight of Toner in Toner Image Formed on Surface of Photoreceptor 1)×100(%)

A: The transfer efficiency is 88% or greater.

C: The transfer efficiency is less than 88%.

Evaluation Test: Evaluation of Image Quality after Lapse of Time

Image quality after lapse of time is evaluated by the following evaluation test. The obtained photoreceptor 1 is mounted on DocuCentre C6550I (manufactured by Fuji Xerox Co., Ltd.), and an image forming test in which an image having an image density of 5% is formed on 100,000 sheets of A4 paper is performed under conditions of 25° C. and 50%. Then, fine line reproducibility of process black 1-dot line at 45° is evaluated by the following standards.

A: Good

B: Partial defect (no problem in practical use).

C: There are defects (the fine line is not reproduced).

Example 2

A charge transport layer is formed in the same manner as in Example 1, and then for a protective layer, a mixture of 0.025 part by weight of a fluorine comb-type graft polymer (trade name: GF300, manufactured by Toagosei Co., Ltd.), 5 parts by weight of polytetrafluoroethylene particles (trade name: LUBRON L2, manufactured by Daikin Industries Ltd.), and 20 parts by weight of cyclopetanone is mixed with a liquid obtained by dissolving 100 parts by weight of a compound represented by the following Structural Formula (G) and 5 parts by weight of melamine represented by the following Structural Formula (H) in 200 parts by weight of cyclopetanone (solvent) and is dispersed using a collision-type high-pressure disperser (trade name: Nanomizer, manufactured by Yoshida Kikai Co., Ltd.). Then, 0.05 part by weight of blocked sulfonic acid (trade name: Nacure 5225, manufactured by King Industries, Inc. is mixed therewith to prepare a coating liquid for protective layer formation.

Structural Formula (G)

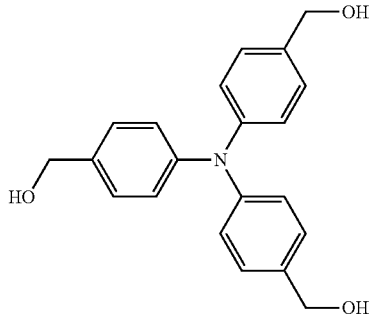

Structural Formula (H)

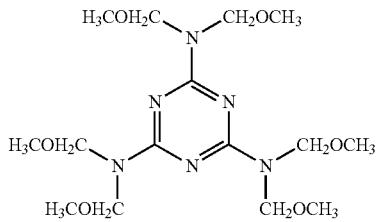

The aluminum substrate having the charge transport layer formed thereon is coated with the obtained coating liquid for protective layer formation by using a dipping method, and drying is performed under conditions of 75° C. and 10 minutes in a first stage and 150° C. and 40 minutes in a second stage to form a protective layer having a thickness of 5 μm, whereby a photoreceptor 2 is prepared.

Example 3

A photoreceptor 3 is prepared in the manner described in Example 1, except that in Example 1, the weight of the fluorine comb-type graft polymer as a dispersion aid for the fluorine resin particles is changed from 0.025 part by weight to 0.05 part by weight.

Example 4

A photoreceptor 4 is prepared in the manner described in Example 2, except that in Example 2, the weight of the fluorine comb-type graft polymer as a dispersion aid for the fluorine resin particles is changed from 0.025 part by weight to 0.05 part by weight.

Example 5

A charge generation layer is prepared in the same manner as in Example 1, and then for a charge transport layer, a mixture of 0.02 part by weight of a fluorine comb-type graft polymer (trade name: GF300, manufactured by Toagosei Co., Ltd.), 5 parts by weight of polytetrafluoroethylene particles (trade name: LUBRON L2, manufactured by Daikin industries Ltd.), and 20 parts by weight of THF is mixed with a liquid obtained by sufficiently dissolving and mixing 42 parts by weight of N,N'-bis(3-methylphenyl)-N,N'-diphenylbenzidine and 58 parts by weight of a bisphenol Z polycarbonate resin (TS2050: viscosity average molecular weight: 50,000: manufactured by Teijin Chemicals Ltd.) in 280 parts by weight of tetrahydrofuran and 120 parts by weight of toluene, and is dispersed using a collision-type high-pressure disperser (trade name: Nanomizer, manufactured by Yoshida Kikai Co., Ltd.). Whereby, a coating liquid for charge transport layer formation is obtained.

The aluminum substrate having the charge generation layer formed thereon is dipped in and coated with the coating liquid for charge transport layer formation, and drying is performed under conditions of 50° C. and 10 minutes in a first stage and 135° C. and 40 minutes in a second stage to form a charge transport layer having a thickness of 20 μm, whereby a photoreceptor 5 is prepared.

Example 6

A photoreceptor 6 is prepared in the manner described in Example 5, except that the weight of the fluorine comb-type graft polymer is changed from 0.02 part by weight to 0.025 part by weight.

Example 7

A photoreceptor 7 is prepared in the manner described in Example 2, except that in Example 2, the weight of the fluorine comb-type graft polymer is changed from 0.025 part by weight to 0.035 part by weight.

Comparative Example 1

A photoreceptor C1 is prepared in the manner described in Example 1, except that the weight of the fluorine comb-type graft polymer is changed from 0.025 part by weight to 0.075 part by weight.

Comparative Example 2

A photoreceptor C2 is prepared in the manner described in Example 2, except that the weight of the fluorine comb-type graft polymer is changed from 0.025 part by weight to 0.075 part by weight.

Comparative Example 3

A photoreceptor C3 is prepared in the manner described in Example 5, except that the weight of the fluorine comb-type graft polymer is changed from 0.02 part by weight to 0.01 part by weight.

Comparative Example 4

A photoreceptor C4 is prepared in the manner described in Example 5, except that the weight of the fluorine comb-type graft polymer is changed from 0.02 part by weight to 0.05 part by weight.

Comparative Example 5

A photoreceptor C5 is prepared in the manner described in Example 2, except that in Example 2, the weight of the fluorine comb-type graft polymer is changed from 0.025 part by weight to 0.005 part by weight.

As for the photoreceptors 2 to 7 in the Examples 2 to 7 and the photoreceptors C1 to C5 in the Comparative Examples 1 to 5, [(A)/(B)] and [(C)/(D)] are measured and the evaluation tests are carried out in the manner described in Example 1.

TABLE 1

| | | Outermost Surface Layer | Amount of Aid [Part by Weight] | (A) | (B) | (A)/(B) | (C) | (D) | (C)/(D) | (E21) | (E6) | Evaluation: Initial Transfer Efficiency | Evaluation: Image Quality after Lapse of Time | Evaluation: Other Image Quality |
|---|---|---|---|---|---|---|---|---|---|---|---|---|---|---|
| Examples | 1 | Protective Layer/Acrylic | 0.025 | 401 | 42 | 9.55 | 59 | 21 | 2.81 | 6 | 10 | 92 (A) | A | — |
| | 2 | Protective Layer | 0.025 | 358 | 37 | 9.68 | 116 | 39 | 2.97 | 0 | 7 | 93 (A) | A | — |
| | 3 | Protective Layer/Acrylic | 0.05 | 378 | 116 | 3.26 | 72 | 61 | 1.18 | 4 | 4 | 92 (A) | A | — |
| | 4 | Protective Layer | 0.05 | 241 | 103 | 2.34 | 128 | 64 | 2.00 | 0 | 5 | 92 (A) | A | — |
| | 5 | Charge Transport Layer | 0.02 | 16 | 20 | 0.80 | 29 | 55 | 0.53 | 0 | 6 | 90 (A) | A | — |
| | 6 | Charge Transport Layer | 0.025 | 14 | 27 | 0.52 | 27 | 67 | 0.40 | 0 | 4 | 90 (A) | A | — |
| | 7 | Protective Layer | 0.035 | 194 | 358 | 0.54 | 24 | 311 | 0.08 | 0 | 4 | 92 (A) | A | — |
| Comparative Examples | 1 | Protective Layer/Acrylic | 0.075 | 0 | 153 | 0 | 39 | 11 | 3.55 | 1 | 5 | 85 (C) | A | — |
| | 2 | Protective Layer | 0.075 | 0 | 171 | 0 | 19 | 81 | 0.23 | 0 | 3 | 87 (C) | A | — |
| | 3 | Charge Transport Layer | 0.01 | 2 | 109 | 0.02 | 83 | 28 | 2.96 | 7 | 19 | 87 (C) | A | — |
| | 4 | Charge Transport Layer | 0.05 | 0 | 90 | 0 | 0 | 41 | 0 | 0 | 5 | 85 (C) | C | — |
| | 5 | Protective Layer | 0.005 | 91 | 8 | 11.38 | 124 | 65 | 1.91 | 9 | 22 | 92 (A) | A | [*1] |

In the above-described Table 1, [*1] in the column of "other image quality" represents that light scattering occurs and image defects such as formation of a blurred image are observed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a substrate; and a photosensitive layer, wherein the electrophotographic photoreceptor has a surface layer containing fluorine resin particles, and the fluorine resin particles exposed on a surface satisfy the following Expression (1):

$$0.5 \leq (A)/(B) \leq 10 \quad \text{Expression (1)}$$

wherein, (A) represents a number of aggregated particles in which 5 to 20 fluorine resin particles are connected and aggregated, and (B) represents a total number of fluorine resin particles that are isolated without being aggregated and aggregated particles in which 2 to 4 fluorine resin particles are connected and aggregated.

2. The electrophotographic photoreceptor according to claim 1, wherein the fluorine resin particles contained in a part of 0.2 μm to 5 μm inside the surface of the surface layer satisfy the following Expression (2):

$$0.1 \leq (C)/(D) \leq 3 \quad \text{Expression (2)}$$

wherein, (C) represents a number of aggregated particles in which 2 to 5 fluorine resin particles are connected and aggregated, and (D) represents a number of fluorine resin particles that are isolated without being aggregated.

3. The electrophotographic photoreceptor according to claim 1, wherein in the fluorine resin particles exposed on the surface, a number of aggregated particles in which 21 or more fluorine resin particles are connected and aggregated is 5 or less.

4. The electrophotographic photoreceptor according to claim 1, wherein the fluorine resin particles contained in a part of 0.2 μm to 5 μm inside the surface of the surface layer include 5 or less aggregated particles in which 6 or more fluorine resin particles are connected and aggregated.

5. The electrophotographic photoreceptor according to claim 1, wherein the (A)/(B) is from 2 to 10.

6. The electrophotographic photoreceptor according to claim 2, wherein the (C)/(D) is from 0.2 to 3.

7. The electrophotographic photoreceptor according to claim 1, wherein a content of the fluorine resin particles is from 1% by weight to 15% by weight with respect to the surface layer.

8. The electrophotographic photoreceptor according to claim 1, wherein an average primary particle diameter of the fluorine resin particles is from 0.05 μm to 1 μm.

9. The electrophotographic photoreceptor according to claim 1, wherein the fluorine resin particles are selected from a tetrafluoroethylene resin, a trifluoroethylene chloride resin, a hexafluoropropylene resin, a vinyl fluoride resin, a vinylidene fluoride resin, and a difluorodichloroethylene resin.

10. The electrophotographic photoreceptor according to claim 1, wherein a fluorinated alkyl group-containing copolymer is further contained.

11. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor with a toner to form a toner image; and a transfer unit that transfers the toner image formed on the surface of the electrophotographic photoreceptor onto a recording medium, wherein the electrophotographic photoreceptor is the electrophotographic photoreceptor according to claim 1.

12. The image forming apparatus according to claim 11, wherein in the electrophotographic photoreceptor, the fluorine resin particles contained in a part of 0.2 μm to 5 μm inside the surface of the surface layer satisfy the following Expression (2):

$$0.1 \leq (C)/(D) \leq 3 \quad \text{Expression (2)}$$

wherein, (C) represents a number of aggregated particles in which 2 to 5 fluorine resin particles are connected and aggregated, and (D) represents a number of fluorine resin particles that are isolated without being aggregated.

13. The image forming apparatus according to claim 11, wherein in the electrophotographic photoreceptor, a number of aggregated particles in which 21 or more fluorine resin particles are connected and aggregated is 5 or less in the fluorine resin particles exposed on the surface.

14. The image forming apparatus according to claim 11, wherein in the photoreceptor, the fluorine resin particles contained in the part that is deeper 0.2 μm to 5 μm inside the surface of the surface layer include 5 or less aggregated particles in which 6 or more fluorine resin particles are connected and aggregated.

15. A process cartridge comprising:

an electrophotographic photoreceptor; and at least one selected from A) a charging unit that charges a surface of the electrophotographic photoreceptor, B) a latent image forming unit that forms an electrostatic latent image on a charged surface of the electrophotographic photoreceptor, C) a developing unit that develops the electrostatic latent image formed on the surface of the electrophotographic photoreceptor with a toner to form a toner image, D) a transfer unit that transfers the toner image formed on the surface of the electrophotographic photoreceptor onto a recording medium, and E) a cleaning unit that cleans the electrophotographic photoreceptor, wherein the electrophotographic photoreceptor is the electrophotographic photoreceptor according to claim 1.

16. The process cartridge according to claim 15, wherein in the electrophotographic photoreceptor, the fluorine resin particles contained in a part of 0.2 μm to 5 μm inside the surface of the surface layer satisfy the following Expression (2):

$$0.1 < (C)/(D) < 3 \quad \text{Expression (2)}$$

wherein, (C) represents a number of aggregated particles in which 2 to 5 fluorine resin particles are connected and aggregated, and (D) represents a number of fluorine resin particles that are isolated without being aggregated.

17. The process cartridge according to claim 15, wherein in the electrophotographic photoreceptor, a number of aggregated particles in which 21 or more fluorine resin particles are connected and aggregated is 5 or less in the fluorine resin particles exposed on the surface.

18. The process cartridge according to claim 15, wherein in the photoreceptor, the fluorine resin particles contained in the part 0.2 μm to 5 μm inside the surface of the surface layer include 5 or less aggregated particles in which 6 or more fluorine resin particles are connected and aggregated.

* * * * *